US007181336B2

(12) United States Patent
Muto et al.

(10) Patent No.: US 7,181,336 B2
(45) Date of Patent: Feb. 20, 2007

(54) CONTROL SYSTEM OF INTERNAL COMBUSTION ENGINE

(75) Inventors: Harufumi Muto, Nishikamo-gun (JP); Yuichiro Ido, Nishikamo-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/563,754

(22) PCT Filed: Jul. 16, 2004

(86) PCT No.: PCT/JP2004/010564

§ 371 (c)(1),
(2), (4) Date: Jan. 9, 2006

(87) PCT Pub. No.: WO2005/019630

PCT Pub. Date: Mar. 3, 2005

(65) Prior Publication Data

US 2006/0161333 A1 Jul. 20, 2006

(30) Foreign Application Priority Data

Aug. 26, 2003 (JP) ..... 2003-208819

(51) Int. Cl.
*F02D 41/00* (2006.01)
*F02D 45/00* (2006.01)

(52) U.S. Cl. ..... 701/108; 701/114

(58) Field of Classification Search ..... 701/108, 701/101, 110, 114, 115; 123/399, 90.15; 73/118.2

See application file for complete search history.

(56) References Cited

U.S. PATENT DOCUMENTS 5,597,951 A 1/1997 Yoshizaki et al.
6,497,214 B2 12/2002 Yagi
6,571,767 B2 6/2003 Kobayashi et al.
6,856,890 B2 * 2/2005 Muto et al. ..... 701/108
6,986,337 B2 * 1/2006 Muto ..... 73/118.2
7,003,390 B2 * 2/2006 Kaga ..... 701/101
2002/0078324 A1 6/2002 Yagi

FOREIGN PATENT DOCUMENTS

DE 197 30 973 A1 * 3/1999
EP 1 662 128 A1 * 5/2006
JP A 05-240104 9/1993
JP A 08-232748 9/1996
JP A 08-232751 9/1996
JP A 11-182356 7/1999
JP A 2000-027692 1/2000
JP A 2001-041095 2/2001
JP A 2002-130039 5/2002
JP A 2002-201998 7/2002

* cited by examiner

*Primary Examiner*—Hieu T. Vo
(74) *Attorney, Agent, or Firm*—Oliff & Berridge, PLC

(57) ABSTRACT

A control system of an internal combustion engine provided with a throttle valve passage air flow calculation equation by which the throttle valve passage air flow mt is expressed as a function of the downstream side intake pipe pressure at the downstream side of the throttle valve and a cylinder intake air flow calculation equation by which the cylinder intake air flow mc is expressed as a function of the downstream side intake pipe pressure, where said downstream side intake pipe pressure Pm and cylinder intake air flow mc when the throttle valve passage air flow mt found from said throttle valve passage air flow calculation equation and the cylinder intake air flow mc found from said cylinder intake air flow calculation equation match are calculated as the downstream side intake pipe pressure Pmta and cylinder intake air flow mcta at the time of steady operation under the operating conditions at that time is provided.

20 Claims, 9 Drawing Sheets

(Pm1 > Pm2)

(Pm1 < Pm2)

CONTROL SYSTEM OF INTERNAL COMBUSTION ENGINE

TECHNICAL FIELD

The present invention relates to a control system of an internal combustion engine.

BACKGROUND ART

In recent years, studies have been conducted on constructing a model of the intake system of an internal combustion engine based on fluid dynamics etc. and using that model to calculate parameters to control the internal combustion engine. That is, for example, a throttle model, intake pipe model, intake valve model, etc. have been constructed for the intake system of internal combustion engines, these models have been used to calculate the cylinder filling air amount etc. from the throttle valve opening degree, atmospheric pressure, atmospheric temperature, etc. and these have been used to control internal combustion engines.

However, when controlling an internal combustion engine, in particular when using the above model to control an internal combustion engine, to calculate the parameters related to the control, sometimes the throttle valve downstream side intake pipe pressure Pmta or cylinder intake air flow mcta at the time of steady operation (or the cylinder air filling rate Klta at the time of steady operation obtained calculated from that (that is, the ratio of mass of cylinder filling air with respect to the mass of the air of the total stroke capacity of the cylinder)) becomes necessary. For example, Japanese Patent Publication (A) No. 2001-41095 discloses a method of calculating a throttle valve passage air flow based on the throttle valve downstream side intake pipe pressure, atmospheric pressure, etc. at that time and the Pmta.

Further, the above throttle valve downstream side intake pipe pressure Pmta or cylinder intake air flow mcta at the time of steady operation has conventionally been found using a map. That is, for example, in the Japanese Patent Publication (A) No. 2001-41095, the Pmta is found from a map using the throttle valve opening degree and/or engine speed etc. as arguments.

However, when actually preparing such a map, a tremendous amount of time becomes necessary. That is, to prepare a map, it is necessary to actually measure the Pmta or mcta while successively changing the arguments. This work becomes tremendous. Further, there is the concern that an increase in the necessary maps or arguments will increase the map searching operation and increase the control load.

DISCLOSURE OF THE INVENTION

The present invention was made in consideration of this problem and has as its object the provision of a control system of an internal combustion engine designed to find at least one of the throttle valve downstream side intake pipe pressure Pmta and cylinder intake air flow mcta at the time of steady operation by a simpler method.

The present invention provides as a means for solving the above problem a control system of an internal combustion engine as described in the claims of the claim section.

In a first aspect of the present invention, there is provided a control system of an internal combustion engine provided with a throttle valve passage air flow calculation equation by which a throttle valve passage air flow is expressed as a function of a downstream side intake pipe pressure at the downstream side of a throttle valve and a cylinder intake air flow calculation equation by which a cylinder intake air flow is expressed as a function of the downstream side intake pipe pressure, the downstream side intake pipe pressure when the throttle valve passage air flow found from the throttle valve passage air flow calculation equation and the cylinder intake air flow found from the cylinder intake air flow calculation equation match being calculated as the downstream side intake pipe pressure at the time of steady operation under the operating conditions at that time.

The downstream side intake pipe pressure at the time of steady operation had in the past been found using a map, but there were the problems that the manhours involved in mapmaking work was tremendous and the control load at the time of map searching was also large.

As opposed to this, in this aspect, the fact that at the time of steady operation, the throttle valve passage air flow and the cylinder intake air flow match is utilized to find by calculation the downstream side intake pipe pressure at the time of the steady operation. For this reason, according to the present embodiment, it is possible to more simply find the downstream side intake pipe pressure at the time of steady operation.

In a second aspect of the present invention, there is provided a control system of an internal combustion engine provided with a throttle valve passage air flow calculation equation by which a throttle valve passage air flow is expressed as a function of a downstream side intake pipe pressure at the downstream side of a throttle valve and a cylinder intake air flow calculation equation by which a cylinder intake air flow is expressed as a function of the downstream side intake pipe pressure, the cylinder intake air flow when the throttle valve passage air flow found from the throttle valve passage air flow calculation equation and the cylinder intake air flow found from the cylinder intake air flow calculation equation match being calculated as the cylinder intake air flow at the time of steady operation under the operating conditions at that time.

The cylinder intake air flow at the time of steady operation had in the past been found using a map. There was the same problem when finding the above downstream side intake pipe pressure at the time of steady operation by a map.

As opposed to this, in this aspect, the fact that at the time of steady operation, the throttle valve passage air flow and the cylinder intake air flow match is utilized to find by calculation the cylinder intake air flow at the time of the steady operation. For this reason, according to the present embodiment, it is possible to more simply find the cylinder intake air flow at the time of steady operation.

In a third aspect of the present invention, the cylinder intake air flow when a throttle valve passage air flow found from the throttle valve passage air flow calculation equation and a cylinder intake air flow found from the cylinder intake air flow calculation equation match is calculated as the cylinder intake air flow at the time of steady operation under the operating conditions at that time.

According to the present embodiment, it is possible to more simply find the downstream side intake pipe pressure and/or cylinder intake air flow at the time of steady operation.

In a fourth aspect of the present invention, the throttle valve passage air flow calculation equation is expressed as the following equation (1) where mt is a throttle valve passage air flow, $\mu$ is a flow coefficient at the throttle valve, At is a cross-sectional area of the opening of the throttle valve, Pa is an atmospheric pressure, Ta is an atmospheric temperature, R is a gas constant, Pm is a downstream side intake pipe pressure, and Φ(Pm/Pa) is a coefficient determined in accordance with the value of Pm/Pa, and the cylinder intake air flow calculation equation is expressed as the following equation (2) where mc is the cylinder intake air flow and a and b are compliance parameters determined based on at least the engine speed:

$$mt = \mu \cdot At \cdot \frac{Pa}{\sqrt{R \cdot Ta}} \cdot \Phi\left(\frac{Pm}{\mathrm{Pa}}\right) \tag{1}$$

$$mc = a \cdot Pm - b \tag{2}$$

According to the present embodiment, relatively simple calculation may be used to accurately find the downstream side intake pipe pressure and/or cylinder intake air flow at the time of steady operation.

In a fifth aspect of the invention, the internal combustion engine has an exhaust gas recirculation passage for making at least part of the exhaust gas discharged into the exhaust passage flow into the intake passage and an EGR control valve for adjusting the flow of the exhaust gas passing through the exhaust gas recirculation passage, the throttle valve passage air flow calculation equation is expressed as the following equation (3) wherein mt is a throttle valve passage air flow, μ is a flow coefficient at the throttle valve, At is a cross-sectional area of the opening of the throttle valve, Pa is an atmospheric pressure, Ta is an atmospheric temperature, R is a gas constant, Pm is a downstream side intake pipe pressure, and Φ(Pm/Pa) is a coefficient determined in accordance with the value of Pm/Pa, and the cylinder intake air flow calculation equation is expressed as the following equation (4) where mc is a cylinder intake air flow, and e and g are compliance parameters determined based on at least an engine speed and an opening degree of the EGR control valve, $$mt = \mu \cdot At \cdot \frac{Pa}{\sqrt{R \cdot Ta}} \cdot \Phi\left(\frac{Pm}{Pa}\right) \tag{3}$$

$$mc = e \cdot Pm + g \tag{4}$$

According to the present embodiment, even when performing exhaust gas recirculation, a relatively simple calculation may be used to accurately find the downstream side intake pipe pressure and/or cylinder intake air flow at the time of steady operation.

In a sixth aspect of the invention, the internal combustion engine further has a variable valve timing mechanism for changing an operating timing of a valve provided in each cylinder and, based on the compliance parameters e and g when the operating timing is a first valve timing and the EGR control valve is at a first opening degree, the compliance parameters e and g when the operating timing is the first valve timing and the EGR control valve is at a second opening degree, and the compliance parameters e and g when the operating timing is a second valve timing and the EGR control valve is at a first opening degree, the compliance parameters e and g when the operating timing is the second valve timing and the EGR control valve is at the second opening degree are estimated.

According to the present embodiment, when exhaust gas recirculation is performed and there is a variable valve timing mechanism, it is possible to reduce the manhours of the mapmaking work for the compliance parameters e and g. Further, if reducing the number of stored maps, it is also possible to reduce the control load at the time of map searching.

In a seventh aspect of the present invention, when the compliance parameters e and g when the operating timing is the second valve timing and the EGR control valve is at a first opening degree respectively take two different values when the throttle valve downstream side intake pipe pressure is larger than and smaller than a first pressure and the compliance parameters e and g when the operating timing is the second valve timing and the EGR control valve is at the second opening degree are estimated to take three or more different values in accordance with the throttle valve downstream side intake pipe pressure, based on the compliance parameters e and g when the operating timing is a first valve timing and the EGR control valve is at a first opening degree, the compliance parameters e and g when the operating timing is the first valve timing and the EGR control valve is at a second opening degree, and the compliance parameters e and g when the operating timing is a second valve timing and the EGR control valve is at a first opening degree, approximated compliance parameters ep and gp designed to take two values differing when the throttle valve downstream side intake pipe pressure is larger and smaller than a first pressure are calculated and these are made the compliance parameters e and g when the operating timing is the second valve timing and the EGR control valve is at the second opening degree.

According to the present embodiment, the processing when finding the downstream side intake pipe pressure and/or cylinder intake air flow at the time of steady operation is simplified and the control load can be reduced.

In an eighth aspect of the invention, the case where the EGR control valve is at the first opening degree is the case where the EGR control valve is closed.

By using the case where the EGR control valve is closed as a standard, it is possible to more accurately estimate the compliance parameters e and g in the case where the operating timing is the second (that is, any) valve timing and the EGR control valve is at the second (that is, any) opening degree. Further, as a result, it is possible to more accurately find the downstream side intake pipe pressure and/or cylinder intake air flow at the time of steady operation.

In a ninth aspect of the invention, at a portion where the throttle valve passage air flow mt and cylinder intake air flow mc invert in magnitude, the throttle valve passage air flow calculation equation used is an approximation equation expressed by a linear equation of the downstream side intake pipe pressure Pm.

In a 10th aspect of the invention, the approximation equation is made a linear equation expressing a line connecting two points on a curve expressed by the throttle valve passage air flow calculation equation and before and after the point where the throttle valve passage air flow mt and cylinder intake air flow mc invert in magnitude.

According to the ninth and 10th aspects, the calculation when finding the downstream side intake pipe pressure and/or cylinder intake air flow at the time of steady operation is simplified and the control load can be reduced.

In an 11th aspect of the invention, instead of the atmospheric pressure Pa, a throttle valve upstream side intake pipe pressure Pac found considering at least a pressure loss of an air cleaner is used.

According to the present embodiment, it is possible to more accurately find the downstream side intake pipe pressure and/or cylinder intake air flow at the time of steady operation.

In a 12th aspect of the invention, a throttle valve upstream side intake pipe pressure Pac found considering at least a pressure loss of an air cleaner is found based on the previously found throttle valve passage air flow, and the approximation equation is made a linear equation expressing a line connecting two points shown by coordinates obtained by multiplying Pac/Pa with values of the downstream side intake pipe pressure and the throttle valve passage air flow showing coordinates of two points on a curve expressed by the throttle valve passage air flow calculation equation and before and after a point where a throttle valve passage air flow mt and cylinder intake air flow mc invert in magnitude.

According to the present embodiment, the calculation when finding the downstream side intake pipe pressure and/or cylinder intake air flow at the time of steady operation is simplified and the control load can be reduced. Further, by considering the pressure loss of the air cleaner etc., it is possible to more accurately find the downstream side intake pipe pressure and/or cylinder intake air flow at the time of steady operation.

Below, the present invention will be understood more fully from the attached drawings and the description of the preferred embodiments of the present invention.

BEST MODE FOR WORKING THE INVENTION

Figure 1:
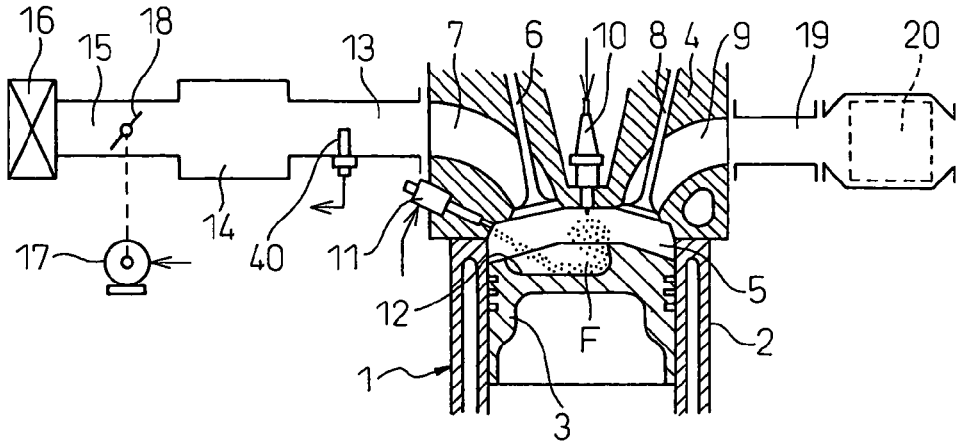
FIG. 1 is a schematic view of an example of the case of applying a control system of an internal combustion engine of the present invention to a cylinder injection type spark ignition internal combustion engine.
Figure 1:
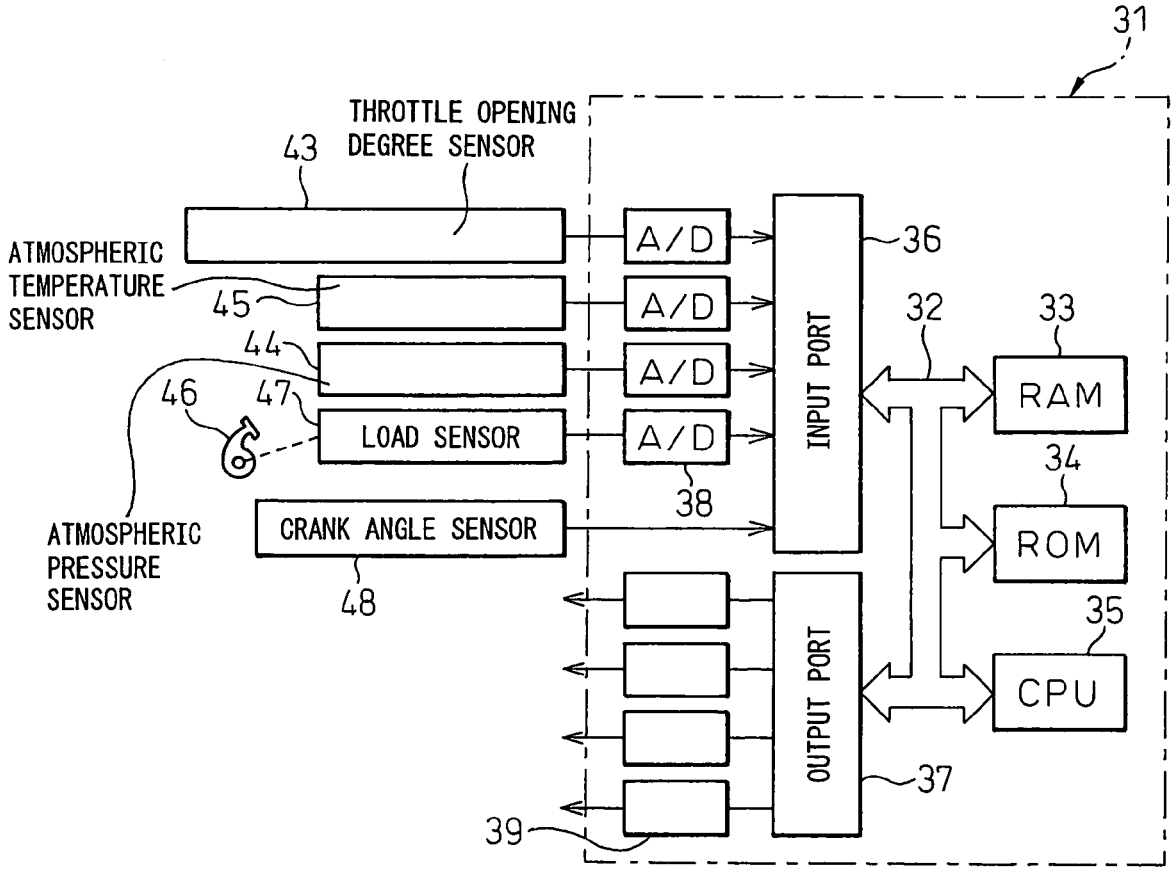

Below, embodiments of the present invention will be explained in detail with reference to the drawings. Note that in the figures, the same or similar elements are assigned common reference numerals.

FIG. 1 is a schematic view showing an example of the case of applying a control system of an internal combustion engine of the present invention to a cylinder injection type spark ignition internal combustion engine. Note that the present invention may also be applied to another spark ignition type internal combustion engine or compression ignition type internal combustion engine.

As shown in FIG. 1, an engine body 1 is provided with a cylinder block 2, pistons 3 reciprocating inside the cylinder block 2, and a cylinder head 4 fixed on the cylinder block 2. The pistons 3 and cylinder head 4 form combustion chambers 5 between them. The cylinder head 4 is provided with, for each cylinder, intake valves 6, intake ports 7, exhaust valves 8, and exhaust ports 9. Further, as shown in FIG. 1, spark plug 10 is provided at the center of the inside wall surface of the cylinder head 4, while fuel injector 11 is provided at the periphery of the inside wall surface of the cylinder head 4. Further, the top surface of each piston 3 is formed with a cavity 12 extending from below the fuel injector 11 to below the spark plug 10.

The intake ports 7 of each cylinder are connected through a downstream side intake pipe 13 to a surge tank 14, while the surge tank 14 is connected through an upstream side intake pipe 15 to an air cleaner 16. Inside the intake pipe 15, a throttle valve 18 driven by a step motor 17 is provided. On the other hand, the exhaust ports 9 of each cylinder are connected to the exhaust pipe 19, and this exhaust pipe 19 is connected to an exhaust purifier 20.

The electronic control unit (ECU) 31 is comprised of a digital computer provided with a RAM (random access memory) 33, ROM (read only memory) 34, CPU (microprocessor) 35, input port 36, and output port 37, connected with each other by a bidirectional bus 32. The intake pipe 13 is provided with an intake pipe pressure sensor 40 for detecting the pressure in the intake pipe. The intake pipe pressure sensor 40 generates an output voltage proportional to the intake pipe pressure. This output voltage is input through the corresponding AD converter 38 to the input port 36.

Further, a throttle valve opening degree sensor 43 for detecting the opening degree of the throttle valve 18, an atmospheric pressure sensor 44 for detecting the pressure of the atmosphere around the internal combustion engine or the pressure of the air taken into the intake pipe 15 (intake pressure), and an atmospheric temperature sensor 45 for detecting the temperature of the atmosphere around the internal combustion engine or the temperature of the air taken into the intake pipe 15 (intake temperature) are provided. The output voltages of these sensors are input to an input port 36 through corresponding AD converters 38. Further, the accelerator pedal 46 is connected to a load sensor 47 generating an output voltage proportional to the amount of depression of an accelerator pedal 46, while the output voltage of the load sensor 47 is input to an input port 36 through the corresponding AD converter 38. A crank angle sensor 48 generates an output pulse each time for example the crankshaft rotates by 30 degrees. This output pulse is input to the input port 36. The CPU 35 uses the output pulse of this crank angle sensor 48 to calculate the engine speed. On the other hand, the output port 37 is connected through a corresponding drive circuit 39 to the spark plugs 10, fuel injectors 11, step motor 17, etc.

Note that, in recent years, control systems of internal combustion engines controlling internal combustion engines based on parameters calculated using the models of the intake systems of internal combustion engines constructed based on fluid dynamics, etc. have been studied. That is, for example, a throttle model, intake pipe model, intake valve model, etc. have been constructed for the intake systems of internal combustion engines, these models have been used to calculate the cylinder filling air amount etc. from the throttle valve opening degree, atmospheric pressure, atmospheric temperature, etc., and the internal combustion engine has been controlled based on this.

Figure 2:
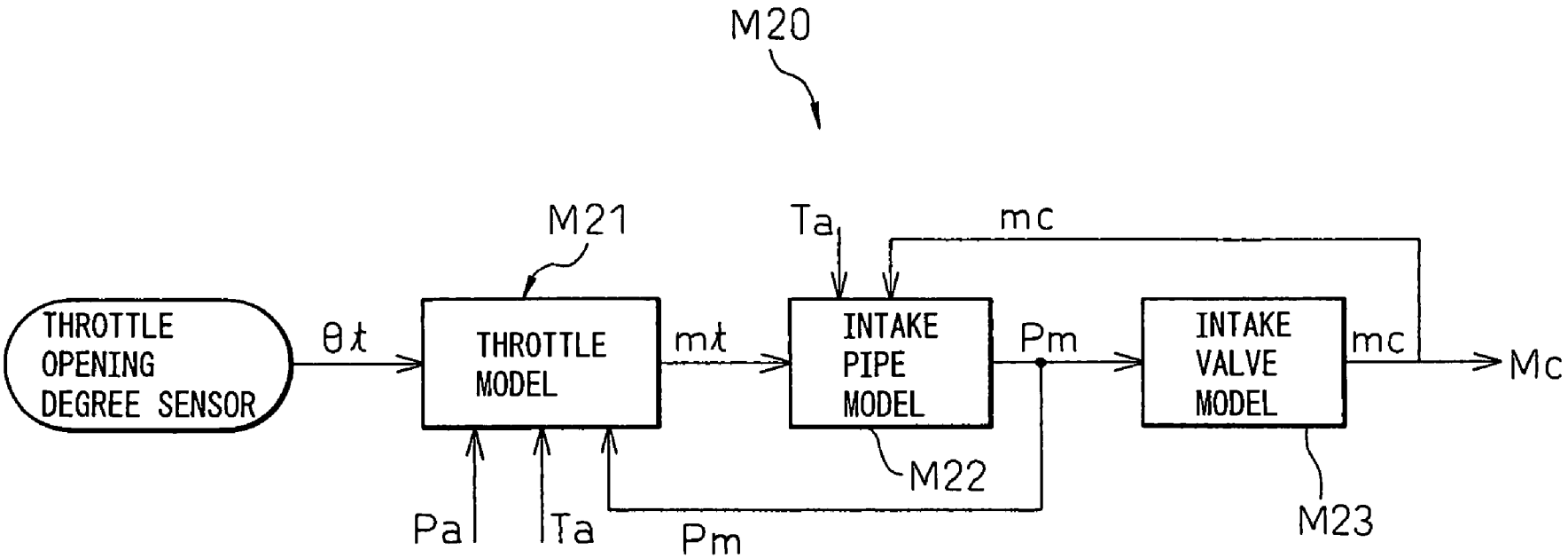
FIG. 2 is a view of an intake air amount model.

Further, in the present embodiment as well, in the configuration shown in FIG. 1, a model is used to control the internal combustion engine. That is, in the present embodiment, usually, the intake air amount model M20 explained below is used for control. FIG. 2 is a view of the intake air amount model M20.

The intake air amount model M20, as shown in FIG. 2, is provided with a throttle model M21, intake pipe model M22, and intake valve model M23. The throttle model M21 uses as input the opening degree θt of the throttle valve detected by the throttle valve opening degree sensor (hereinafter referred to as the "throttle valve opening degree"), the atmospheric pressure Pa around the internal combustion engine detected by an atmospheric pressure sensor, the atmospheric temperature Ta around the internal combustion engine detected by an atmospheric temperature sensor, and the pressure Pm in the intake pipe at the downstream side from the throttle valve calculated in the later explained intake pipe model M22 (hereinafter referred to as the "downstream side intake pipe pressure"). By entering the values of these input parameters into the model equations of the later explained throttle model M21, the flow of the air passing through the throttle valve per unit time (hereinafter referred to as the "throttle valve passage air flow mt") is calculated. The throttle valve passage air flow mt calculated in the throttle model M21 is input to the intake pipe model M22.

The intake pipe model M22 uses as input the throttle valve passage air flow mt calculated in the throttle model M21 and the flow of air flowing into the combustion chamber per unit time explained in detail below (hereinafter referred to as the "cylinder intake air flow mc". Note that the definition of the cylinder intake air flow mc is described in detail in the intake valve model M23). By entering the values of these input parameters into the model equations of the later explained intake pipe model M22, the downstream side intake pipe pressure Pm and the temperature Tm in the intake pipe at the downstream side of the throttle valve (hereinafter referred to as the "downstream side intake pipe temperature") are calculated. The downstream side intake pipe pressure Pm calculated at the intake pipe model M22 is input to the intake valve model M23 and throttle model M21.

The intake valve model M23 uses as input the downstream side intake pipe pressure Pm calculated at the intake pipe model M22. By entering this value into the model equations of the later explained intake valve model M23, the cylinder intake air flow mc is calculated. The calculated cylinder intake air flow mc is converted to the cylinder filling air amount Mc. Based on this cylinder filling air amount Mc, the amount of fuel injection from the fuel injector is determined. Further, the cylinder intake air flow mc calculated at the intake valve model M23 is input to the intake pipe model M22.

As will be understood from FIG. 2, in the intake air amount model M20, the value of the parameters calculated in a certain model are utilized as input values to another model, so in the intake air amount model M20 as a whole, the actually input values are the throttle valve opening degree θt, atmospheric pressure Pa, and atmospheric temperature Ta, that is, only three parameters. The cylinder filling air amount Mc is calculated from these three parameters.

Next, each of the models M21 to M23 of the intake air amount model M20 will be explained.

Figure 3:
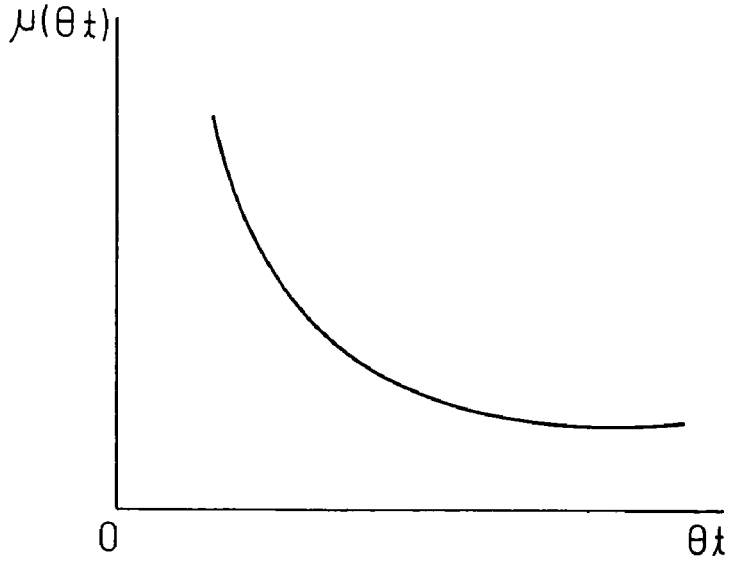
FIG. 3 is a view of the relationship between the throttle valve opening degree and flow coefficient.

In the throttle model M21, the throttle valve passage air flow mt(g/s) is calculated based on the following equation (5) from the atmospheric pressure Pa(kPa), atmospheric temperature Ta(K), downstream side intake pipe pressure Pm(kPa), and throttle valve opening degree θt. Here, the μ in equation (5) is the flow coefficient in the throttle valve, is a function of the throttle valve opening degree θt, and is determined from the map shown in FIG. 3. Further, At($m^2$) shows the cross-sectional area of the opening of the throttle valve (hereinafter referred to as "throttle opening area") and is a function of the throttle valve opening degree θt. Note that it is also possible to find μ·At combining these flow coefficient μ and throttle opening area At from the throttle valve opening degree θt by a single map. Further, R is the gas constant.

$$mt = \mu \cdot At \cdot \frac{Pa}{\sqrt{R \cdot Ta}} \cdot \Phi\left(\frac{Pm}{Pa}\right) \tag{5}$$

Figure 4:
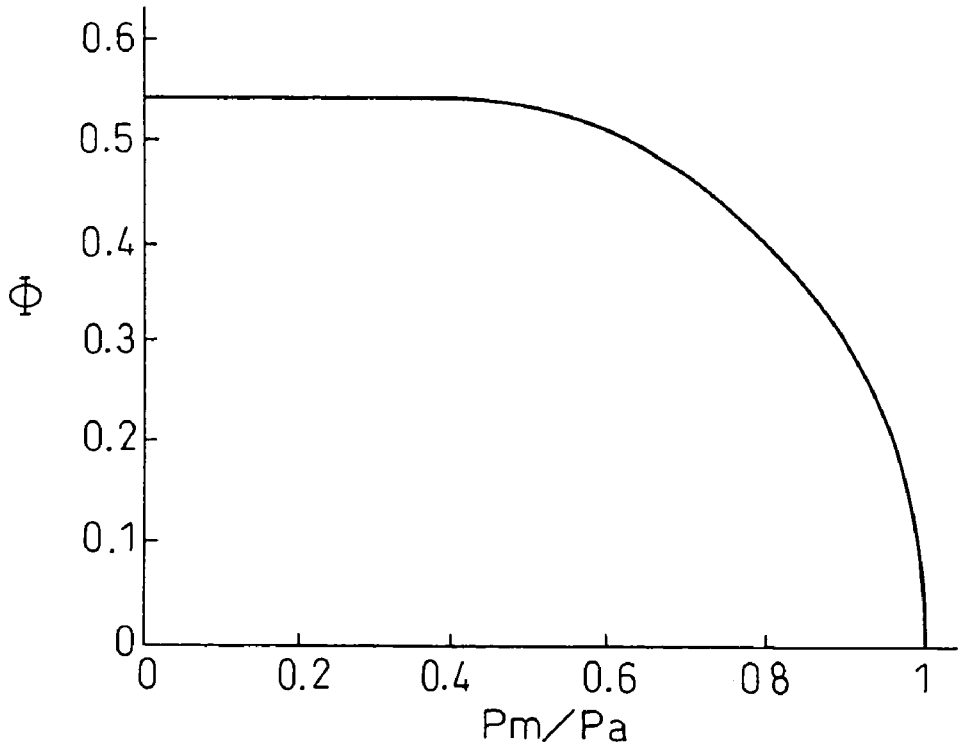
FIG. 4 is a view of a function Φ(Pm/Pa).

Φ(Pm/Pa) is a function of the following equation (6). The κ in this equation (6) is the specific heat ratio (κ=Cp (constant pressure specific heat)/Cv (constant volume specific heat), made constant value). This function Φ(Pm/Pa) can be expressed by the graph as shown in FIG. 4, so this graph may be stored as a map in the ROM of the ECU and the value of Φ(Pm/Pa) may be found from the map instead of actual calculation using equation (6).

$$\Phi\left(\frac{Pm}{Pa}\right) = \begin{cases} \sqrt{\dfrac{\kappa}{2(\kappa+1)}} & \cdots \dfrac{Pm}{Pa} \leqq \dfrac{1}{\kappa+1} \\ \sqrt{\left\{\left(\dfrac{\kappa-1}{2\kappa}\right)\cdot\left(1-\dfrac{Pm}{Pa}\right)+\dfrac{Pm}{Pa}\right\}\cdot\left(1-\dfrac{Pm}{Pa}\right)} & \cdots \dfrac{Pm}{Pa} > \dfrac{1}{\kappa+1} \end{cases} \tag{6}$$

Figure 5:
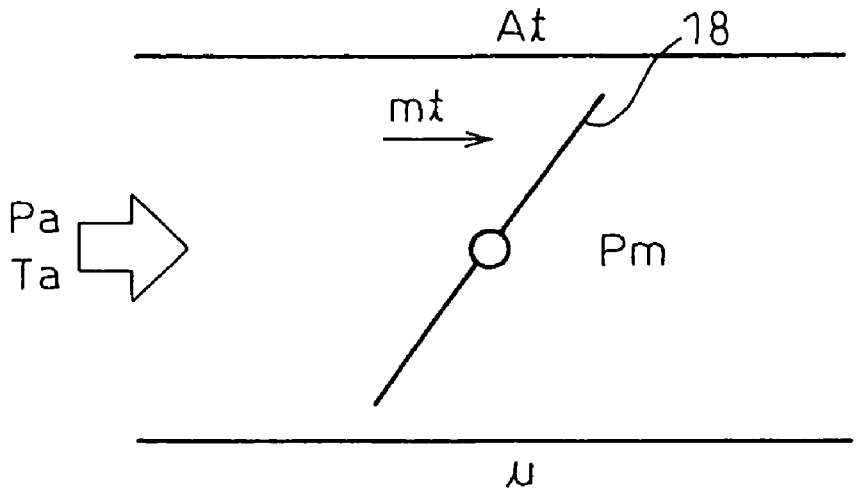
FIG. 5 is a view of the basic concept of a throttle model.

Equation (5) and equation (6) of the throttle model M21 are obtained by making the pressure of the gas upstream of the throttle valve 18 the atmospheric pressure Pa, making the temperature of the gas upstream of the throttle valve 18 the atmospheric temperature Ta, making the pressure of the gas passing through the throttle valve 18 the downstream side intake pipe pressure Pm, applying the Law of the Conservation of Mass, the Law of the Conservation of Energy, and the Law of Conservation of Motion to the model of the throttle valve 18 shown in FIG. 5, and utilizing the gas state equation, the definition of specific heat ratio, and Mayer's formula.

In the intake pipe model M22, the downstream side intake pipe pressure Pm(kPa) and downstream side intake pipe temperature Tm(K) are calculated from the throttle valve passage air flow mt(g/s), cylinder intake air flow mc(g/s), and atmospheric temperature Ta(K) based on the following equation (7) and equation (8). Note that Vm($m^3$) in equation (7) and equation (8) is a constant equal to the volume of the portion 13' of the intake pipe etc. from the throttle valve to the intake valve (hereinafter referred to as the "intake pipe part").

$$\frac{d}{dt}\left(\frac{Pm}{Tm}\right) = \frac{R}{Vm}\cdot(mt - mc) \tag{7}$$

$$\frac{dPm}{dt} = \kappa\cdot\frac{R}{Vm}\cdot(mt\cdot Ta - mc\cdot Tm) \tag{8}$$

Figure 6:
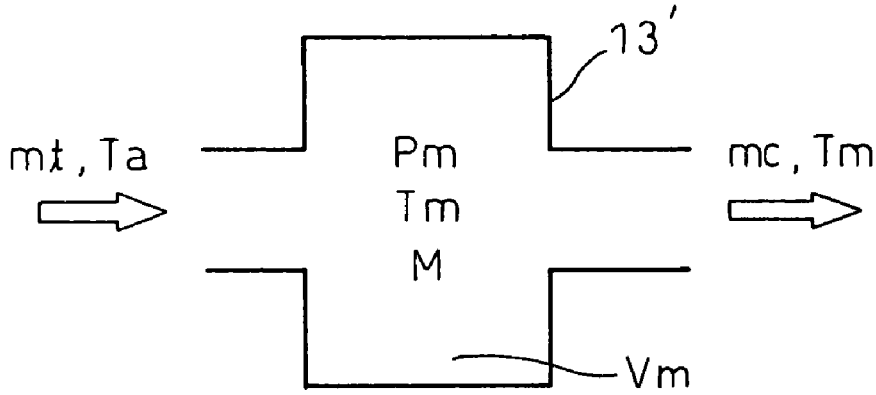
FIG. 6 is a view of the basic concept of an intake pipe model.

Here, the intake pipe model M22 will be explained with reference to FIG. 6. If the total amount of gas of the intake pipe part 13' is M, the change over time of the total amount M of gas is equal to the difference between the flow of gas flowing into the intake pipe part 13', that is, the throttle valve passage air flow mt, and the flow of gas flowing out from the intake pipe part 13', that is, the cylinder intake air flow mc. From the Law of Conservation of Mass, the following equation (9) is obtained. From this equation (9) and the gas state equation (Pm·Vm=M·R·Tm), equation (7) is obtained.

$$\frac{dM}{dt} = mt - mc \tag{9}$$

Further, the amount of change over time of the energy M·Cv·Tm of the gas of the intake pipe part 13' is equal to the difference between the energy of the gas flowing into the intake pipe part 13' and the energy of the gas flowing out of the intake pipe part 13'. For this reason, if the temperature of the gas flowing into the intake pipe part 13' is made the atmospheric temperature Ta and the temperature of the gas flowing out from the intake pipe part 13' is made the downstream side intake pipe temperature Tm, according to the Law of the Conservation of Energy, the following equation (10) is obtained. From this equation (10) and the gas state equation, equation (8) is obtained:

$$\frac{d(M\cdot Cv\cdot Tm)}{dt} = Cp\cdot mt\cdot Ta - Cp\cdot mc\cdot Tm \tag{10}$$

In the intake valve model M23, the cylinder intake air flow mc is calculated from the downstream side intake pipe pressure Pm based on the following equation (11). Note that a and b in equation (11) are compliance parameters determined based on at least the engine speed NE. A map is prepared in advance and the map is searched through in accordance with need to find these.

$$mc = a\cdot Pm - b \tag{11}$$

Figure 7:
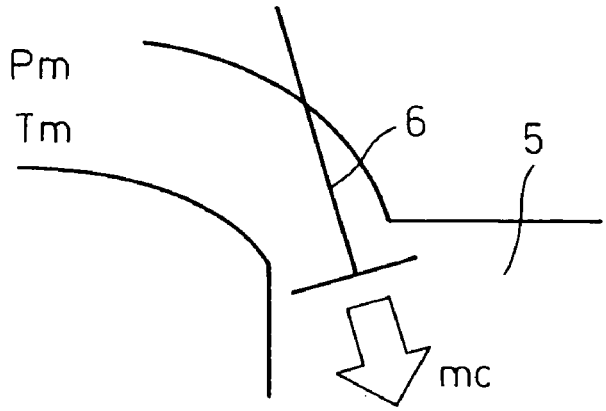
FIG. 7 is a view of the basic concept of an intake valve model.

The above-mentioned intake valve model M23 will be explained with reference to FIG. 7. In general, the amount of air filled in the combustion chamber 5 when the intake valve 6 is closed, that is, the cylinder filling air amount Mc, is determined when the intake valve 6 is closed (at the time the intake valve is closed) and is proportional to the pressure in the combustion chamber 5 at the time the intake valve is closed. Further, the pressure in the combustion chamber 5 at the time the intake valve is closed can be deemed equal to the pressure of the gas upstream of the intake valve, that is, the downstream side intake pipe pressure Pm. Therefore, the cylinder filling air amount Mc can be approximated as being proportional to the downstream side intake pipe pressure Pm.

Here, if making the average of the total amount of air flowing out from the intake pipe part 13' per unit time or the average of the amount of air taken in from the intake pipe part 13' to all combustion chambers 5 per unit time over the intake stroke of one cylinder the cylinder intake air flow mc (explained in detail below), since the cylinder filling air amount Mc is proportional to the downstream side intake pipe pressure Pm, the cylinder intake air flow mc can also be considered proportional to the downstream side intake pipe pressure Pm. From this, the equation (11) is obtained based on logic and experience. Note that the compliance parameter a in equation (11) is a proportional coefficient, while the compliance parameter b is a value relating to the amount of burnt gas remaining in the combustion chamber 5 when the exhaust valve is closed (explained below).

Note that by having the compliance parameters a and b take two different values (for example, a1, b1 and a2, b2) when the downstream side intake pipe pressure Pm is large and when it is small even if the engine speed etc. are the same, that is, by having the cylinder intake air flow mc shown by two equations like equation (11) (that is, the linear equation of downstream side intake pipe pressure Pm), it is learned that sometimes it is possible to find the cylinder intake air flow mc more accurately. This is believed to be related to the fact that, and in particular when both the intake valves 6 and exhaust valves 7 are open (that is, valve overlap) etc., the burnt gas flows back to the intake ports 7. That is, when there is valve overlap, when the downstream side intake pipe pressure Pm is the predetermined pressure or more, the higher the downstream side intake pipe pressure Pm, the much less the backflow of the burnt gas, so compared with when the predetermined pressure or less, the value of a is made larger and the value of b is made smaller.

Figure 8:
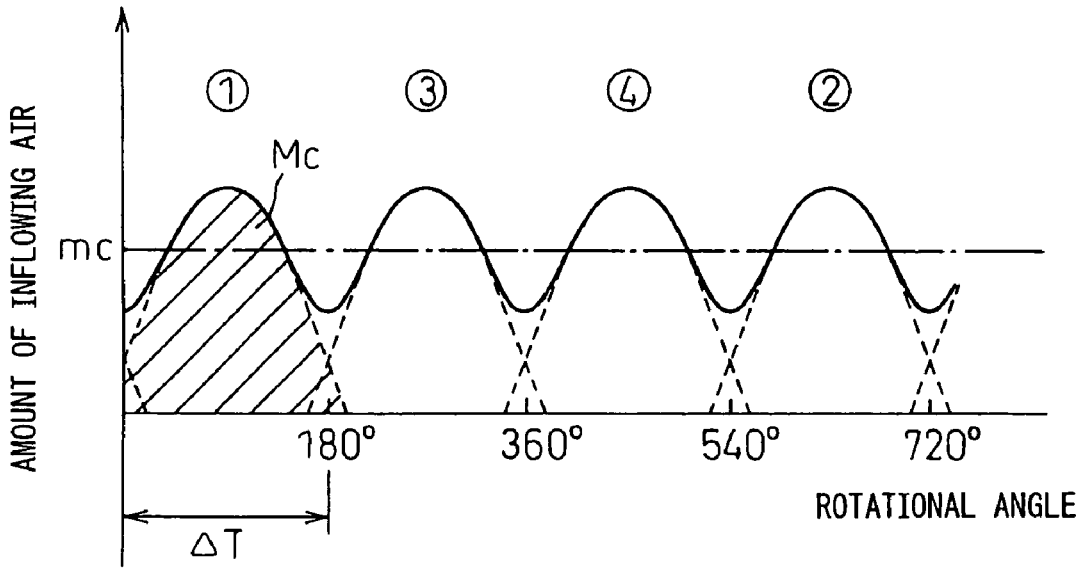
FIG. 8 is a view of definitions of the cylinder filling air amount and cylinder intake air flow.

Here, the cylinder intake air flow mc will be explained with reference to FIG. 8 for the case where the internal combustion engine has four cylinders. Note that FIG. 8 shows on the abscissa the rotational angle of the crankshaft and the ordinate the amount of air actually flowing from the intake pipe part 13' to the combustion chamber 5 per unit time. As shown in FIG. 8, in a four-cylinder internal combustion engine, the intake valves 6 opens in the order of for example the #1 cylinder, #3 cylinder, #4 cylinder, and #2 cylinder and air flows from the intake pipe part 13' to the combustion chamber 5 of each cylinder in accordance with the amount of opening of the intake valves 6 corresponding to each cylinder. The change in the flow of the air flowing from the intake pipe part 13' to the combustion chamber 5 of each cylinder is as shown by the broken line in FIG. 8, while the flow of air flowing from the intake pipe part 13' to the combustion chambers 5 of all cylinders is as shown by the solid line in FIG. 8. Further, for example, the cylinder filling air amount Mc to the #1 cylinder corresponds to the part shown by the hatching in FIG. 8.

As opposed to this, the average of the amount of air flowing from the intake pipe part 13' into the combustion chambers 5 of all cylinders shown by the solid line is the cylinder intake air flow mc and is shown by the one-dot chain line in the figure. Further, the cylinder intake air flow mc shown by the one-dot chain line multiplied with the time $\Delta T_{180°}$ taken for the crankshaft to rotate 180° in the case of four cylinders (that is, in a four-stroke type internal combustion engine, the angle 720° which the crankshaft rotates in one cycle divided by the number of cylinders) becomes the cylinder filling air amount Mc. Therefore, by multiplying the cylinder intake air flow mc calculated by the intake valve model M23 with $\Delta T_{180°}$, it is possible to calculate the cylinder filling air amount Mc ($Mc=mc\cdot\Delta T_{180°}$). Further, by dividing this cylinder filling air amount Mc by the mass of the air occupying a volume corresponding to the amount of exhaust per cylinder in the state of 1 atm and 25° C., it is possible to calculate the cylinder air filling rate Kl. Note that, as clear from the above explanation, it is believed that if multiplying the value b in equation (11) with $\Delta T_{180°}$, the amount of burnt gas remaining in the combusion chamber 5, at the time the exhaust valve 8 is closed, is obtained.

Next, the case of using the intake air amount model M20 to actually calculate the cylinder filling air amount Mc will be explained. The cylinder filling air amount Mc is expressed by using the intake air amount model M20 to solve the equation (5), equation (7), equation (8), and equation (11). In this case, for processing at the ECU, it is necessary to make these equations discrete. If using the time t and calculation interval (discrete time) Δt to make equation (5), equation (7), equation (8), and equation (11) discrete, the following equation (12), equation (13), equation (14), and equation (15) are obtained. Note that, the downstream side intake pipe temperature Tm(t+Δt) is calculated by equation (16) from Pm/Tm(t+Δt) and Pm(t+Δt) calculated by equation (13) and equation (14), respectively:

$$mt(t) = \mu \cdot At(\theta t(t)) \cdot \frac{Pa}{\sqrt{R \cdot Ta}} \Phi\left(\frac{Pm(t)}{Pa}\right) \tag{12}$$

$$\frac{Pm}{Tm}(t+\Delta t) = \frac{Pm}{Tm}(t) + \Delta t \cdot \frac{R}{Vm} \cdot (mt(t) - mc(t)) \tag{13}$$

$$Pm(t+\Delta t) = Pm(t) + \Delta t \cdot \kappa \cdot \frac{R}{Vm} \cdot (mt(t) \cdot Ta - mc(t) \cdot Tm(t)) \tag{14}$$

$$mc(t) = a \cdot Pm(t) - b \tag{15}$$

$$Tm(t+\Delta t) = \frac{Pm(t+\Delta t)}{Pm / Tm(t+\Delta t)} \tag{16}$$

In the intake air amount model M20 mounted in this way, the throttle valve passage air flow mt(t) at the time t calculated by equation (12) of the throttle model M21 and the cylinder intake air flow mc(t) at the time t calculated by equation (15) of the intake valve model M23 are entered in equation (13) and equation (14) of the intake pipe model M22. Due to this, the downstream side intake pipe pressure Pm(t+Δt) and the downstream side intake pipe temperature Tm(t+Δt) at the time t+Δt are calculated. Next, the calculated Pm(t+Δt) are entered into equation (12) and equation (15) of the throttle model M21 and intake valve model M23. Due to this, the throttle valve passage air flow mt(t+Δt) and cylinder intake air flow mc(t+Δt) at the time t+Δt are calculated. Further, by repeating this calculation, the cylinder intake air flow mc at any timing t is calculated from the throttle valve opening degree θt, atmospheric pressure Pa, and atmospheric temperature Ta, and the calculated cylinder intake air flow mc is multiplied with the time $\Delta T_{180°}$ so as to calculate the cylinder filling air amount Mc at any timing t.

Note that, at the time of start of the internal combustion engine, that is, at the time t=0, the downstream side intake pipe pressure Pm is made equal to the atmospheric pressure (Pm(0)=Pa), the downstream side intake pipe temperature Tm is made equal to the atmospheric temperature (Tm(0)=Ta), and the calculations in the models M21 to M23 are started.

Note that, in the intake air amount model M20, it is assumed that the atmospheric temperature Ta and atmospheric pressure Pa are constant, but it is also possible to make the values change along with time. For example, it is also possible to enter the value detected at the time t by an atmospheric temperature sensor for detecting the atmospheric temperature as the atmospheric temperature Ta(t) and enter the value detected at the time t by an atmospheric pressure sensor for detecting the atmospheric pressure as the atmospheric pressure Pa(t) into the equation (12) and equation (14).

However, when controlling an internal combustion engine, in particular when using a model to control an internal combustion engine, to calculate the parameters relating to control, sometimes the throttle valve downstream side intake pipe pressure Pmta and/or cylinder intake air flow mcta at the time of steady operation (or the cylinder air filling rate Klta at the time of steady operation able to be calculated from this) is necessary. Here, the value at the time of steady operation (Pmta, mcta, etc.) means the finally taken value when steadily operating the internal combustion engine in a certain state, that is, the value considered as the convergence value. These values are used in control of an internal combustion engine mainly for avoiding complicated calculation or reducing the amount of calculation so as to reduce the control load or for improving the precision of the parameters calculated. Further, these values may be made the ones found using maps in the past.

That is, for example, the practice is to prepare in advance a map for finding that value using the throttle valve opening degree, engine speed, or other indicator of the operating state as arguments, store it in the ROM, and search through the map based on the operating state at that time to find the required value. However, to actually prepare such a map, a tremendous amount of time is required. That is, to prepare a map, it is necessary to actually measure the Pmta or mcta while successively changing the arguments. The work becomes tremendous. Further, there is the concern that an increase in the necessary maps or arguments will increase the map searching operation and increase the control load.

Therefore, in the control system of an internal combustion engine of the present embodiment, when the Pmta and/or mcta (or Klta) is necessary, the method explained below is used to find it without using a map. Note that, as will be clear from the following explanation, this method utilizes the fact that at the time of steady operation, the throttle valve passage air flow mt and cylinder intake air flow mc match.

That is, the control system of an internal combustion engine of the present embodiment provides as calculation equations of the throttle valve passage air flow mt the following equation (17) and equation (18) (that is, the equation (5) and equation (6). Below, "equation (17) etc.")

$$mt = \mu \cdot At \cdot \frac{Pa}{\sqrt{R \cdot Ta}} \cdot \Phi\left(\frac{Pm}{Pa}\right) \tag{17}$$

$$\Phi\left(\frac{Pm}{Pa}\right) = \begin{cases} \sqrt{\dfrac{\kappa}{2(\kappa+1)}} & \cdots \dfrac{Pm}{Pa} \leqq \dfrac{1}{\kappa+1} \\ \sqrt{\left\{\left(\dfrac{\kappa-1}{2\kappa}\right)\cdot\left(1-\dfrac{Pm}{Pa}\right)+\dfrac{Pm}{Pa}\right\}\cdot\left(1-\dfrac{Pm}{Pa}\right)} & \cdots \dfrac{Pm}{Pa} > \dfrac{1}{\kappa+1} \end{cases} \tag{18}$$

Further, the control system of an internal combustion engine of the present embodiment provides as a calculation equation of the cylinder intake air flow mc the following equation (19) (that is, the equation (11)):

$$mc = a \cdot Pm - b \tag{19}$$

Further, when the internal combustion engine is in steady operation, the throttle valve passage air flow mt and the cylinder intake air flow mc match. Therefore, if finding the downstream side intake pipe pressure Pm when the throttle valve passage air flow mt found from the equation (17) etc. and the cylinder intake air flow mc found from the equation (19) match, the downstream side intake pipe pressure Pmta at the time of steady operation under the operating conditions at that time is found. Further, in the same way, by finding the cylinder intake air flow mc when the throttle valve passage air flow mt found from the equation (17) etc. and the cylinder intake air flow mc found from the equation (19) match, it is possible to find the cylinder intake air flow mcta at the time of steady operation under the operating conditions at that time (further, it is also possible to find the cylinder air filling rate Klta at the time of steady operation from this value).

Figure 9:
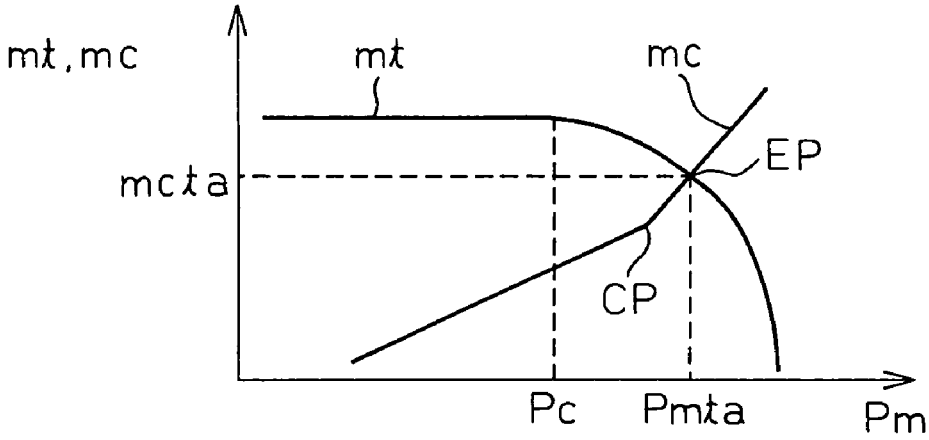
FIG. 9 is a view of the relationship of a downstream side intake pipe pressure Pm and throttle valve passage air flow mt and cylinder intake air flow mc and shows that the downstream side intake pipe pressure Pm when the throttle valve passage air flow mt and cylinder intake air flow mc become equal is the downstream side intake pipe pressure Pmta at the time of steady operation and that the cylinder intake air flow mc at that time is the cylinder intake air flow mcta at the time of steady operation.

Further, finding the Pmta and mcta in this way is synonymous with finding the intersecting point EP between the curve mt expressed by the equation (17) etc. and the line mc expressed by the equation (19) as shown in FIG. 9. Here, when finding the intersecting point EP, if using equation (17) expressing the curve mt as it is to try to find the intersecting point EP, the calculation becomes extremely complicated. Therefore, to simplify the calculation, it is also possible to approximate the equation (17) etc. by a plurality of linear equations of the downstream side intake pipe pressure Pm. That is, the curve mt is approximated by a plurality of lines. Specifically, for example, it is also possible to calculate the throttle valve passage air flow mt based on the equation (17) etc. at every constant interval of the downstream side intake pipe pressure Pm, find the points on the curve mt at constant intervals of the downstream side intake pipe pressure Pm, and find the lines connecting the adjoining two points as the approximated lines of the curve mt. Further, the linear equations expressing these approximated lines become the approximated linear equations, of the equation (17) etc.

However, the approximation of the equation (17) etc. by linear equations is for easily finding the intersecting point EP, so what is necessary here is an approximated linear equation of the equation (17) etc. in the vicinity of the intersecting point EP. Therefore, it is also possible to find only this approximated linear equation. In this case, it is also possible to find in advance the cylinder intake air flow mc based on the equation (19) every constant interval of the downstream side intake pipe pressure Pm and find the point where the throttle valve passage air flow mt and the cylinder intake air flow mc invert in magnitude so as to specify the position of the intersecting point EP.

Figure 10:
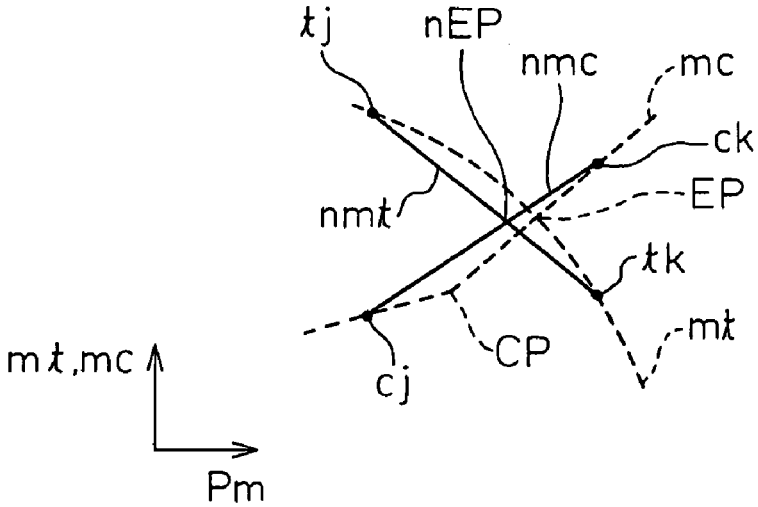
FIG. 10 is an enlarged view of the vicinity of an intersecting point EP for a view similar to FIG. 9 and is a view to explain approximating a curve expressing the throttle valve passage air flow mt by a line and approximating two lines expressing the cylinder intake air flow mc by a single line.

More specifically, the approximated linear equation at the vicinity of the intersecting point EP (that is, the portion where the throttle valve passage air flow mt and cylinder intake air flow mc invert in magnitude), for example, is made the linear equation expressing the line nmt connecting the two points tj and tk on the curve mt expressed by the equation (17) etc. which are the points before and after the throttle valve passage air flow mt and the cylinder intake air flow mc invert in magnitude (see FIG. 10).

Note that in the region where the downstream side intake pipe pressure Pm is the critical pressure Pc (that is, the pressure where even if the downstream side intake pipe pressure Pm becomes that pressure or less, the throttle valve passage flow mt does not increase further) or less, mt becomes a constant value, so even if not using the above-mentioned approximation, the intersecting point EP can be easily found.

Further, when the compliance parameters a and b of equation (19) take two different values when the downstream side intake pipe pressure Pm is large and when it is small (for example, a1, b1 and a2, b2), that is, when as shown in FIG. 9 the cylinder intake air flow mc is shown by two lines connected by the connection point CP, when the connection point CP is in the vicinity of the intersecting point EP, by approximating the two lines by one line in the vicinity of the intersecting point EP, it is possible to simplify the calculations for finding the intersecting point EP and lighten the control load.

Specifically, for example, as shown in FIG. 10, the two lines showing the cylinder intake air flow mc are approximated by one line. That is, in this case, the cylinder intake air flow mc is shown by two equations expressed in the form of equation (19) (that is, two linear equations of downstream side intake pipe pressure Pm with different compliance parameters a and b), but these equations are approximated in the vicinity of the intersecting point EP by a linear equation expressing the line nmc connecting the points cj and ck, one of which is on one of the two lines mc expressed by the two equations and which are at the positions sandwiching the connection point CP and the intersecting point EP.

In the example shown in FIG. 10, the curve mt showing the throttle valve passage air flow mt in the vicinity of the intersecting point EP is approximated by the line nmt, and the two lines expressing the cylinder intake air flow mc are approximated by a single line nmc. Due to this, the intersecting point nEP sought becomes slightly different from the intersecting point EP, but this intersecting point nEP can be simply found by calculation finding the intersecting point of the two lines nmt and nmc. That is, according to this method, it is possible to simply find the approximated values of the downstream side intake pipe pressure Pmta and cylinder intake air flow mcta at the time of steady operation.

However, in the above-mentioned equation (17) etc., the throttle valve passage air flow mt is calculated using the intake pipe pressure at the upstream side of the throttle valve 18 (hereinafter referred to as the "upstream side intake pipe pressure") as the atmospheric pressure Pa. However, the actual upstream side intake pipe pressure usually becomes a pressure lower than atmospheric pressure during engine operation since there is pressure loss at the upstream side of the throttle valve in the engine intake system. In particular, in the configuration shown in FIG. 1, the air cleaner 16 is provided at the upstream-most part in the engine intake system, so to more precisely calculate the throttle valve passage air flow mt, it is preferable to consider at least the pressure loss of the air cleaner 16.

Therefore, in a control system of an internal combustion engine of another embodiment of the present invention, to more accurately calculate the throttle valve passage air flow mt, instead of the equation (17) etc., it is also possible to provide the following equation (20) and equation (21) (hereinafter referred to as "equation (20) etc.") as the equations for calculation of the throttle valve passage air flow mt. In equation (20) etc., at the portion in the equation (17) etc. where the atmospheric pressure Pa is used, the upstream side intake pipe pressure Pac found considering at least the pressure loss of the air cleaner is used.

$$mt = \mu \cdot At \cdot \frac{Pac}{\sqrt{R \cdot Ta}} \cdot \Phi\left(\frac{Pm}{Pac}\right) \tag{20}$$

$$\Phi\left(\frac{Pm}{Pac}\right) = \begin{cases} \sqrt{\dfrac{\kappa}{2(\kappa+1)}} & \cdots \dfrac{Pm}{Pac} \leqq \dfrac{1}{\kappa+1} \\ \sqrt{\left\{\left(\dfrac{\kappa-1}{2\kappa}\right)\cdot\left(1-\dfrac{Pm}{Pac}\right)+\dfrac{Pm}{Pac}\right\}\cdot\left(1-\dfrac{Pm}{Pac}\right)} & \cdots \dfrac{Pm}{Pac} > \dfrac{1}{\kappa+1} \end{cases} \tag{21}$$

By using the equation (20) etc. as the calculation equation of the throttle valve passage air flow mt, it is possible to more accurately find the downstream side intake pipe pressure Pmta and cylinder intake air flow mcta at the time of steady operation by the above-mentioned method.

However, the upstream side intake pipe pressure Pac may also be detected by providing a pressure sensor directly upstream of the throttle valve 18, but it is also possible to calculate it without using a pressure sensor. That is, the difference between the atmospheric pressure Pa and the upstream side intake pipe pressure Pac can be expressed as in the following equation (22) by Bernoulli's theorum:

$$\mathrm{Pa} - Pac = \frac{1}{2}\rho v^2 = k\frac{Ga^2}{\rho} \tag{22}$$

Here, ρ is the atmospheric density, v is the velocity of the air passing through the air cleaner 16, Ga is the flow of the air passing through the air cleaner 16, and k is a proportional coefficient between v and Ga. If using the standard atmospheric density ρ0, the pressure correction coefficient ekpa for converting the standard atmospheric density ρ0 to the current atmospheric density ρ, and the temperature correction coefficient ektha, equation (22) can be replaced by equation (23). Further, equation (23) can be replaced by equation (24) using the function f(Ga) having just the flow Ga as a variable.

$$\mathrm{Pa} - Pac = \frac{k}{\rho 0} \cdot Ga^2 \cdot \frac{1}{ekpa \cdot ektha} \tag{23}$$

$$\mathrm{Pa} - Pac = \frac{f\,(Ga)}{ekpa \cdot ektha} \tag{24}$$

Equation (24) can be modified to equation (25) showing the upstream side intake pipe pressure Pac. In equation (25), the flow Ga can be detected by an air flow meter provided at the immediately downstream side of the air cleaner 16 when such an air flow meter is provided. Further, the pressure correction coefficient ekpa can be set by the detected atmospheric pressure Pa, while the temperature correction coefficient ektha can be set by the detected atmospheric temperature Ta.

$$Pac = \mathrm{Pa} - \frac{f\,(Ga)}{ekpa \cdot ektha} \tag{25}$$

Further, in equation (25), the flow Ga of the air passing through the air cleaner 16 can be considered to be the throttle valve passage air flow mt. Equation (25) can be modified to equation (26):

$$Pac = \mathrm{Pa} - \frac{f\,(mt)}{ekpa \cdot ektha} \tag{26}$$

However, since the current upstream side intake pipe pressure Pac is necessary for calculating the current throttle valve passage air flow mt based on equation (20) etc., to calculate the current upstream side intake pipe pressure Pac based on equation (26), it is necessary to use as the throttle valve passage air flow mt, the previous throttle valve passage air flow mt, that is, throttle valve passage air flow mt of one discrete time before. In this respect, repeated calculation can improve the precision of the calculated upstream side intake pipe pressure Pac, but to avoid an increase in control load, it is also possible to use the upstream side intake pipe pressure Pac found based on the previously found throttle valve passage air flow mt as the current (present) upstream side intake pipe pressure Pac.

Further, it is also possible to use the following method to find the downstream side intake pipe pressure Pmta and the cylinder intake air flow mcta at the time of steady operation when considering at least the pressure loss of the air cleaner 16. That is, with this method, in the above method of approximating the equation (17) etc. at least in the vicinity of the intersecting point EP by a linear equation, finding the intersecting point between the approximated line shown by that approximated linear equation and the line expressed by the equation (19) (or its approximated line), and finding the downstream side intake pipe pressure Pmta and cylinder intake air flow mcta at the time of steady operation, the approximated linear equation of the equation (17) etc. (or approximated line expressed by the approximated linear equation) is corrected using the upstream side intake pipe pressure Pac.

That is, in the above method, the approximated line of the curve mt expressed by the equation (17) etc., as shown in FIG. 10, was found as the line nmt connecting the two points tj and tk on the curve mt before and after the throttle valve passage air flow mt and cylinder intake air flow mc invert in magnitude, but with this method, the values of the downstream side intake pipe pressure and throttle valve passage air flow showing the coordinates of the two points tj and tk are multiplied with Pac/Pa and the line connecting the two points shown by the new coordinates (approximated line after correction) is found (the linear equation expressing this line becomes a corrected approximated linear equation).

Further, by finding the intersecting point between this approximated line after correction and the line expressed by the equation (19) (or its approximated line), the downstream side intake pipe pressure Pmta and cylinder intake air flow mcta at the time of steady operation when considering at least the pressure loss of the air cleaner 16 are found.

Figure 11:
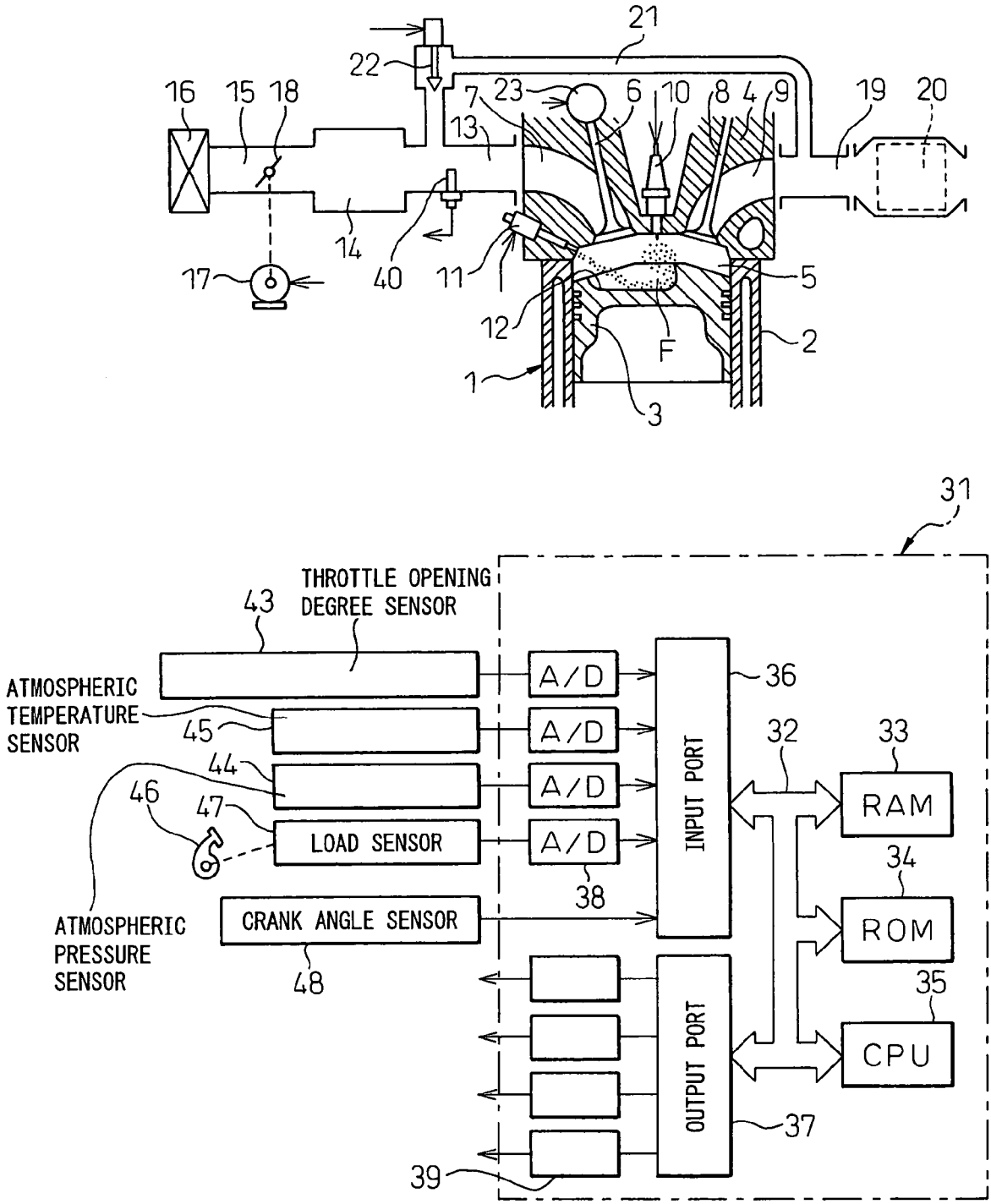
FIG. 11 is a schematic view of an example of the case of applying a control system of an internal combustion engine of the present invention to a cylinder injection type spark ignition internal combustion engine different from FIG. 1.

Next, another embodiment of the present invention will be explained with reference to FIG. 11. FIG. 11 is a schematic view of an example of the case of applying a control system of an internal combustion engine of the present invention to a cylinder injection type spark ignition internal combustion engine different from FIG. 1. The configuration shown in FIG. 11 is basically the same as the configuration shown in FIG. 1. Explanations of common parts are in principle omitted.

Compared with the configuration shown in FIG. 1, the configuration shown in FIG. 11 differs in that the exhaust passage (exhaust port, exhaust pipe, etc.) and intake passage (intake port and intake pipe) are connected to each other through an exhaust gas recirculation passage (hereinafter referred to as "EGR passage") 21 and a control valve 22 for adjusting the flow of the exhaust gas passing through the exhaust gas recirculation passage 21 (hereinafter referred to as an "EGR control valve") is arranged in this exhaust gas recirculation passage 21. That is, in the present embodiment, sometimes exhaust gas recirculation for making part of the exhaust gas discharged to the exhaust passage flow into the intake passage (hereinafter referred to as "EGR") is performed.

Further, the configuration shown in FIG. 11 differs from the configuration shown in FIG. 1 in the point that it is provided with a variable valve timing mechanism 23 for changing the operating timing of the intake valves 6. Note that the EGR control valve 22 and variable valve timing mechanism 23 are both controlled by the ECU 31.

Further, in the present embodiment as well, a model is constructed for the configuration shown in FIG. 11. In the same way as the case of the above-mentioned other embodiment, the model is used for control of the internal combustion engine. Further, in the present embodiment as well, in the same way as the above-mentioned other embodiment, when the downstream side intake pipe pressure Pmta and/or cylinder intake air flow mcta at the time of steady operation (or the cylinder air filling rate Klta at the time of steady operation able to be calculated from this) is necessary, the fact that the throttle valve passage air flow mt and the cylinder intake air flow mc match at the time of steady operation is utilized and these values are found by calculation.

However, in the present embodiment, EGR is sometimes performed. Further, sometimes the operating timing of the intake valves 6 (hereinafter referred to as simply as "valve timing") is changed. For this reason, the control system of an internal combustion engine of the present embodiment is provided with the following equation (27) instead of the equation (19) as the calculation equation of the cylinder intake air flow mc used for calculation of the Pmta and/or mcta.

That is, in the present embodiment, the downstream side intake pipe pressure Pm when the throttle valve passage air flow mt found from the equation (17) etc. and cylinder intake air flow mc found from the following equation (27) match is found as the Pmta, and the cylinder intake air flow mc at that time is found as the mcta. Alternatively, when considering at least the pressure loss due to the air cleaner 16, the downstream side intake pipe pressure Pm when the throttle valve passage air flow mt found from the equation (20) etc. and the cylinder intake air flow mc found from the following equation (27) match is found as the Pmta, and the cylinder intake air flow mc at that time is found as the mcta.

$$mc=e\cdot Pm+g \tag{27}$$

Equation (27) is an equation obtained since even if EGR is performed and/or the valve timing is changed, the cylinder intake air flow mc changes substantially linearly based on the downstream side intake pipe pressure Pm. Here, e and g are compliance parameters different from the compliance parameters a and b in equation (19) (or equation (11)), that is, are compliance parameters determined based on at least the engine speed NE, EGR control valve opening degree STP, and valve timing VT. Further, by making the compliance parameters e and g take different values for each predetermined range of the downstream side intake pipe pressure Pm even if the engine speed NE, EGR control valve opening degree STP, valve timing VT, or other operating conditions are the same, that is, by expressing the cylinder intake air flow mc by a plurality of equations like the equation (27) (that is, linear equation of downstream side intake pipe pressure Pm), it is learned that sometimes the cylinder intake air flow mc can be found more accurately.

The compliance parameters e and g may be found by preparing in advance a map using the engine speed NE, EGR control valve opening degree STP, and valve timing VT as arguments and searching through the map based on the operating conditions at that time in accordance with need, but it is also possible to use the method explained below to estimate the necessary compliance parameters e and g and therefore sharply cut the manhours for making the map. Further, if using this method in accordance with need to estimate the compliance parameters e and g, it is possible to reduce the number of maps stored and lighten the control load for map searching.

That is, with this method, for the case of each engine speed NE, only the compliance parameters exn and gxn when the EGR control valve opening degree STP is a certain single EGR control valve opening degree STPx and when making the valve timing VT each valve timing VTn and the compliance parameters emx and gmx when the valve timing VT is a certain single valve timing VTx and when making the EGR control valve opening degree STP each EGR control valve opening degree STPm are found and these are used to estimate compliance parameters emn and gmn at the time of any other EGR control valve opening degree STPm and any other valve timing VTn. This method utilizes the fact that when the engine speed NE is constant, the amount of the EGR gas sucked into the cylinder is substantially determined by the EGR control valve opening degree STP and downstream side intake pipe pressure Pm.

Below, this will be explained more specifically. For example, when the engine speed NE is NE1, if the compliance parameters when the EGR control valve opening degree STP is the closed state STP0 and the valve timing VT is the reference timing VT0 (that is, advance=0) are designated as e00, g00, the cylinder intake air flow mc00 at that time can be expressed by the following equation (28).

$$mc00=e00\cdot Pm+g00 \tag{28}$$

Similarly, if the compliance parameters when the EGR control valve opening degree STP is STP1 and the valve timing VT is the reference timing VT0 (that is, advance=0) are designated as e10, g10, the cylinder intake air flow mc10 at that time can be expressed by the following equation (29).

$$mc10=e10\cdot Pm+g10 \tag{29}$$

Further, from these equation (28) and equation (29), the flow mcegr10 of the EGR gas flowing into the cylinder (hereinafter referred to as "cylinder intake EGR flow") when the EGR control valve opening degree STP is STP1 and the valve timing VT is the reference timing VT0 (that is, advance=0) can be expressed by the following equation (30). Here E and G are coefficients expressing the calculated values of the corresponding compliance parameters.

$$\begin{aligned} mcegr10 &= mc00 - mc10 \\ &= (e00 - e10)\cdot Pm + (g00 - g10) \\ &= E\cdot Pm + G \end{aligned} \tag{30}$$

Figure 12:
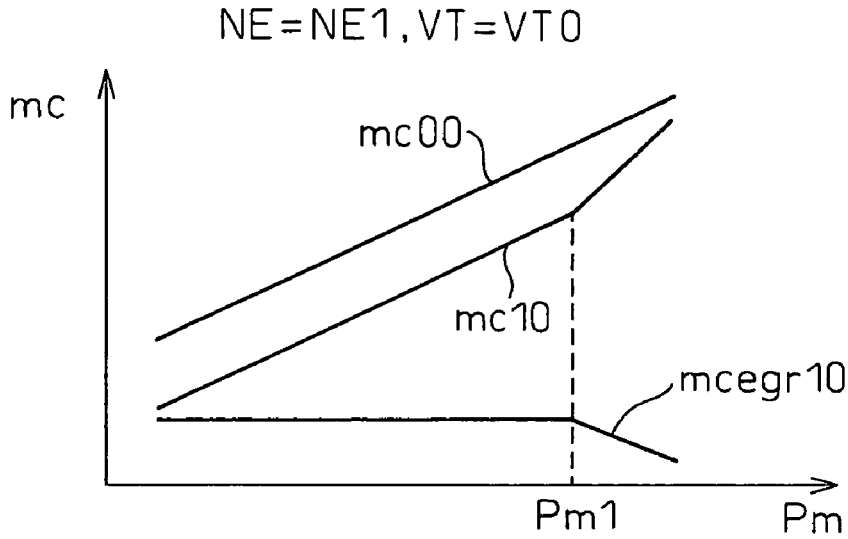
FIG. 12 is a view for explaining the method of utilizing compliance parameters e and g under predetermined conditions to estimate the compliance parameters e and g under any conditions.

If illustrating these equation (28) to equation (30), for example, the result becomes FIG. 12. In the example of FIG. 12, the compliance parameters e10 and g10 are assumed to take different values when the downstream side intake pipe pressure Pm is the predetermined pressure Pm1 or more and when it is less than the predetermined pressure Pm1. As a result, the coefficients E and G are assumed to take different values when the downstream side intake pipe pressure Pm is the predetermined pressure Pm1 or more and when it is less than the predetermined pressure Pm1. Further, in this example, when the downstream side intake pipe pressure Pm is less than the predetermined pressure Pm1, the compliance parameters e00 and e10 are assumed to be substantially equal.

Further, in the same way as equation (28) and equation (29), when the engine speed NE is NE1, if the compliance parameters when the EGR control valve opening degree STP is the closed state STP0 and the valve timing VT is VT1 are designated as e01, g01, the cylinder intake air flow mc01 at that time can be expressed by the following equation (31).

$$mc01 = e01\cdot Pm + g01 \tag{31}$$

Further, here, when the engine speed NE is constant, the amount of the EGR gas taken into the cylinder is substantially determined by the EGR control valve opening degree STP and the downstream side intake pipe pressure Pm. If considering this, the cylinder intake EGR flow mcegr11 when the EGR control valve opening degree STP is STP1 and the valve timing VT is VT1 is substantially equal to the above mcegr10 and can be expressed by the above equation (30).

Further, from this, the cylinder intake air flow mc11 when the EGR control valve opening degree STP is STP1 and the valve timing VT is VT1 can be expressed as in the following equation (32) from equation (30) and equation (31).

$$\begin{aligned} mc11 &= (e01 - e00 + e10)\cdot Pm + (g01 - g00 + g10) \\ &= (e01 - E)\cdot Pm + (g01 - G) \end{aligned} \tag{32}$$

That is, the compliance parameters e11 and g11 when the EGR control valve opening degree STP is STP1 and the valve timing VT is VT1 are expressed as in the following equation (33). That is, the compliance parameters e11 and g11 when the EGR control valve opening degree STP is STP1 and the valve timing VT is VT1 can be estimated from the compliance parameters e00 and g00 when the EGR control valve opening degree STP is STP0 and the valve timing VT is VT0, the compliance parameters e10 and g10 when the EGR control valve opening degree STP is STP1 and the valve timing VT is VT0, and the compliance parameters e01 and g01 when the EGR control valve opening degree STP is STP0 and the valve timing VT is VT1.

$$\left.\begin{aligned} e11 &= e01 - e00 + e10 \\ g11 &= g01 - g00 + g10 \end{aligned}\right\} \tag{33}$$

Figure 13:
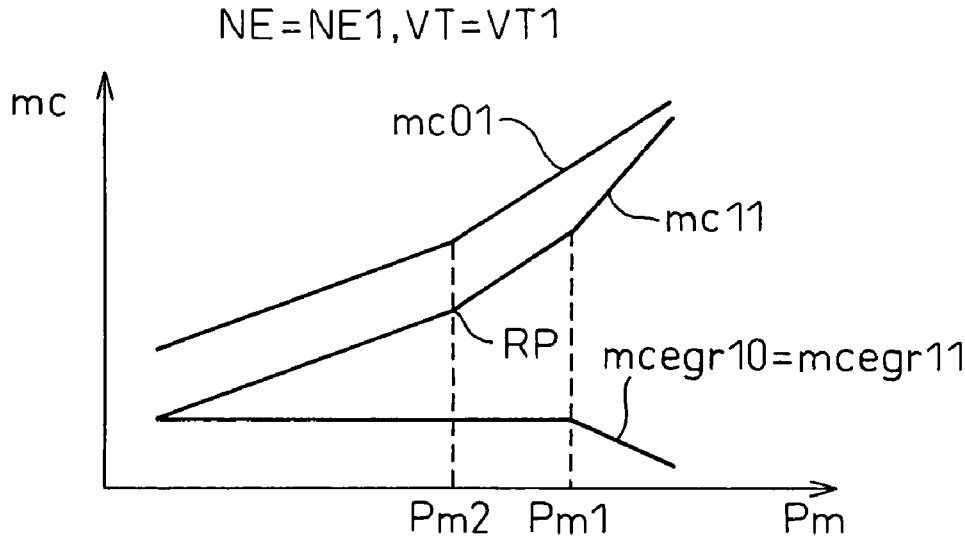
FIG. 13 is also a view for explaining the method of utilizing compliance parameters e and g under predetermined conditions to estimate the compliance parameters e and g under any conditions.

These equation (30), equation (31), and equation (32), if illustrated, becomes as shown for example in FIG. 13. In the example of FIG. 13, the compliance parameters e01 and g01 are assumed to take different values when the downstream side intake pipe pressure Pm is the predetermined pressure Pm2 or more and when it is less than the predetermined pressure Pm2.

Note that, above, to simplify the explanation, the explanation was given of the case of estimating the unknown compliance parameters e11 and g11 based on the case where the EGR control valve opening degree STP was in the closed state STPO, but the present invention is not limited to this. However, when the EGR control valve opening degree STP is in the closed state STP0, compared with other cases, it is possible to find the compliance parameters e and g more precisely, so by using the case where the EGR control valve opening degree STP is the closed state STP0 as the standard, it becomes possible as a result to precisely estimate the unknown compliance parameters e11 and g11.

Further, as clear from the above explanation, according to this method, if finding the compliance parameters exn and gxn when the EGR control valve opening degree STP is a certain EGR control valve opening degree STPx and the valve timing VT is each valve timing VTn and compliance parameters emx and gmx when the valve timing VT is a certain valve timing VTx and the EGR control valve opening degree STP is each EGR control valve opening degree STPm for the case of each engine speed NE, it is possible to use these to estimate the compliance parameters emn and gmn at the time of any other EGR control valve opening degree STPm and any valve timing VTn. Further, from this, it is possible to greatly reduce the manhours for map making.

However, as in the case shown in FIG. 13, when both the cylinder intake EGR flow mcegr10 and the cylinder intake air flow mc01 are shown by two lines connected by connection points, the cylinder intake air flow mc11 estimated based on these becomes shown by three lines connected by two connection points. If the cylinder intake air flow is shown by three lines in this way, compared with when shown by two lines, the processing for calculation when finding the intersecting point with the curve etc. showing the throttle valve passage air flow mt for finding the Pmta and/or mcta becomes extremely troublesome.

Therefore, to lighten the control load, it is also possible to approximate the three lines showing the cylinder intake air flow by two lines by the method explained below. That is, this method approximates the three lines expressing the estimated cylinder intake air flow mc11 by two lines using as a reference point, of the two connection points connecting them, the connection point RP with the same Pm coordinate as the connection point of the two lines expressing the cylinder intake air flow mc01 forming the basis for the estimation. That is, an equation expressing the two approximated lines connected by the connection point RP is found. What is expressed by these two lines is the approximated cylinder intake air flow mc'11 approximating the cylinder intake air flow mc11. Below, this will be explained more specifically with reference to FIG. 14 and FIG. 15.

Figure 14:
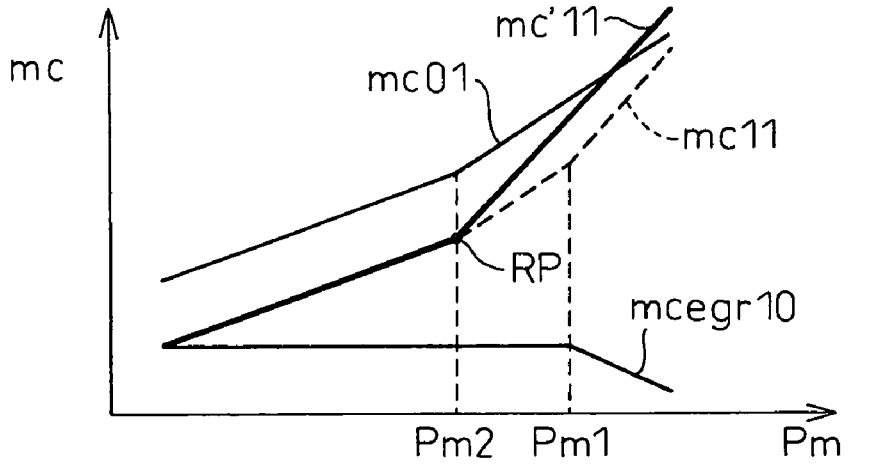
FIG. 14 is a view for explaining the method of approximating a cylinder intake air flow mc11 expressed by three lines by an approximated cylinder intake air flow mc'11 expressed by two lines and shows the case where the predetermined pressure Pm1 is larger than a predetermined pressure Pm2.
Figure 15:
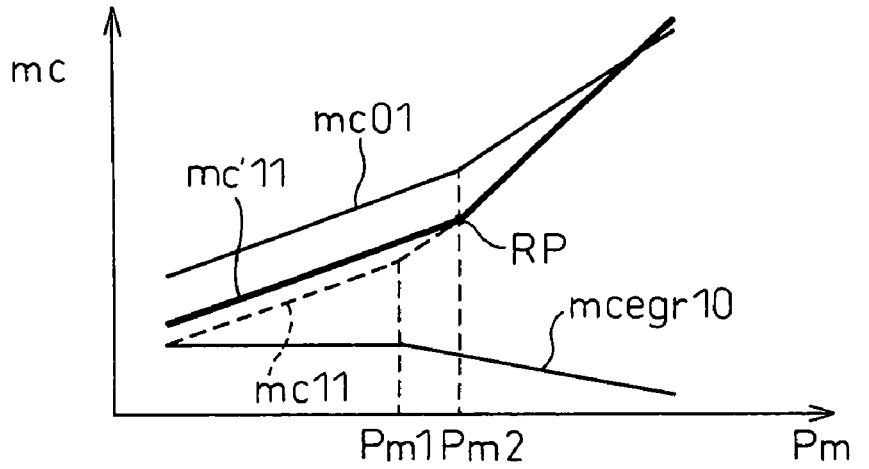
FIG. 15 is a view similar to FIG. 14 and shows the case where the predetermined pressure Pm1 is smaller than a predetermined pressure Pm2.

As shown in FIG. 14 and FIG. 15, when the cylinder intake EGR flow mcegr10 is shown by two lines connected by a connection point, in the equation (30), the coefficients E and G take different values when the downstream side intake pipe pressure Pm is the predetermined pressure Pm1 or more and when it is less than the predetermined pressure Pm1. In this case, if the cylinder intake EGR flow mcegr10 when the downstream side intake pipe pressure Pm is less than the predetermined pressure Pm1 is mcegrl10, the coefficients E and G when the downstream side intake pipe pressure Pm is less than the predetermined pressure Pm1 are El and Gl, the cylinder intake EGR flow mcegr10 when the downstream side intake pipe pressure Pm is the predetermined pressure Pm1 or more is mcegrh10, and the coefficients E and G when the downstream side intake pipe pressure Pm is the predetermined pressure Pm1 or more are Eh and Gh, the equation (30) can be expressed as in the following equation (34).

$$\left.\begin{aligned} mcegrl10 &= El \cdot Pm + Gl, \quad Pm < Pm1 \\ mcegrh10 &= Eh \cdot Pm + Gh, \quad Pm \geqq Pm1 \end{aligned}\right\} \tag{34}$$

Similarly, as shown in FIG. 14 and FIG. 15, when the cylinder intake air flow mc01 is shown by two lines connected by a connection point, the compliance parameters e01 and g01 in the equation (31) take different values when the downstream side intake pipe pressure Pm is a predetermined pressure Pm2 or more and when it is less than a predetermined pressure Pm2. In this case, if the cylinder intake air flow mc01 when the downstream side intake pipe pressure Pm is less than the predetermined pressure Pm2 is mcl10, the compliance parameters e01 and g01 when the downstream side intake pipe pressure Pm is less than the predetermined pressure Pm2 are el01 and gl01, the cylinder intake air flow mc01 when the downstream side intake pipe pressure Pm is the predetermined pressure Pm2 or more is mch01, and the compliance parameters e01 and g01 when the downstream side intake pipe pressure Pm is the predetermined pressure Pm2 or more are eh01 and gh01, the equation (31) can be expressed by the following equation (35):

$$\left.\begin{aligned} mcl01 &= el01 \cdot Pm + gl01, \quad Pm < Pm2 \\ mch01 &= eh01 \cdot Pm + gh01, \quad Pm \geqq Pm2 \end{aligned}\right\} \tag{35}$$

Further, with this method, the cylinder intake air flow mc11 is approximated by a line of the slant (el01−El) when the downstream side intake pipe pressure Pm is less than a predetermined pressure Pm2 and is approximated by a line of the slant (eh01−Eh) when the downstream side intake pipe pressure Pm is the predetermined pressure Pm2 or more. Further, these two approximated lines are connected by the connection point RP.

The equation expressing this approximated line, that is, the equation expressing the approximated cylinder intake air flow mc'11 approximating the cylinder intake air flow mc11, becomes a different equation when the downstream side intake pipe pressure Pm is the predetermined pressure Pm2 or more and when it is less than the predetermined pressure Pm2 and is used selectively depending on the relative magnitude of the predetermined pressures Pm1 and Pm2.

The equation expressing the approximated cylinder intake air flow mc'11 found by this method, when Pm1>Pm2 as shown in FIG. 14, can be expressed by the following equation (36) when the approximated cylinder intake air flow mc'11 when the downstream side intake pipe pressure Pm2 is mc'l11 and the approximated cylinder intake air flow mc'11 when the downstream side intake pipe pressure Pm is the predetermined pressure Pm2 or more is mc'h11:

$$\left.\begin{aligned} mc'l11 &= (el01 - El) \cdot Pm + (gl01 - Gl) \\ &= epla11 \cdot Pm + gpla11, \quad Pm < Pm2 \\ mc'h11 &= (eh01 - Eh) \cdot Pm + (Eh - El) \cdot \\ &\quad Pm2(gh01 - Gl) \\ &= eh01 - Eh) \cdot Pm + \\ &\quad \frac{(Eh - El)(gh01 - gl01)}{el01 - eh01} + (gh01 - Gl) \\ &= epha11 \cdot Pm + gpha11, \quad Pm \geqq Pm2 \end{aligned}\right\} \tag{36}$$

Here, epla11, gpla11, epha11, and gpha11 are coefficients obtained by rewriting the corresponding parts in the equations and are approximated compliance parameters. Further, in this case, the coordinates of the connection point RP in FIG. 14 can be expressed using the predetermined pressure Pm2 as (Pm2, (eh01−El)·Pm2+(gh01−Gl)).

On the other hand, as shown in FIG. 15, when Pm1<Pm2, the equation expressing the approximated cylinder intake air flow mc'11 can be expressed by the following equation (37).

$$\begin{aligned} mc'l11 &= (el01 - El) \cdot Pm + \\ &\quad (eh01 - el01 + El - Eh)\, Pm2 + (gh01 - Gh) \\ &= (el01 - El) \cdot Pm + \\ &\quad \frac{(Eh01 - el01 + El - Eh)(gh01 - gl01)}{el01 - eh01} + \\ &\quad (gh01 - Gh) \\ &= eplb11 \cdot Pm + gplb11, \quad Pm < Pm2 \\ mc'h11 &= (eh01 - Eh) \cdot Pm + (gh01 - Gh) \\ &= ephb11 \cdot Pm + gphb11, \quad Pm \geqq Pm2 \end{aligned} \tag{37}$$

Here, eplb11, gplb11, ephb11, and gphb11 are coefficients obtained by rewriting the corresponding parts of the equations and are approximated compliance parameters. Further, in this case, the coordinates of the connection point RP in FIG. 15 can be expressed using the predetermined pressure Pm2 as (Pm2, (el01−Eh)·Pm2+(gl01−Gh)).

Further, as clear from FIG. 14 and FIG. 15, when using this method to find the approximated cylinder intake air flow mc'11, when Pm1>Pm2, if the downstream side intake pipe pressure Pm is less than the predetermined pressure Pm2, the approximated cylinder intake air flow mc'11 matches with the cylinder intake air flow mc11, while when Pm1<Pm2, if downstream side intake pipe pressure Pm is the predetermined pressure Pm2 or more, the approximated cylinder intake air flow mc'11 matches with the cylinder intake air flow mc11. Note that, when Pm1=Pm2, as the cylinder intake air flow mc11 is originally shown by two lines, it is not necessary to use the above-mentioned method to find the approximated cylinder intake air flow mc'11.

Further, it is learned that even if using the method explained above to find the approximated cylinder intake air flow mc'11 and using this as the basis to find the Pmta or mcta, the effect on the calculation precision is relatively small. This is because when the engine speed NE is from the low speed to medium speed, the tendency is that Pm1≅Pm2, while when the engine speed NE is the high speed, the tendency is that El≅Eh.

Note that, only naturally, even in the case of EGR explained later, it is possible to linearly approximate the curve showing the throttle valve passage air flow mt by any one of the methods explained above to find the Pmta or mcta.

Further, in the configuration shown in FIG. 11, the variable valve timing mechanism 23 was provided only at the intake valve 6 side, but the present invention is not limited to this. That is, for example, a variable valve timing mechanism may also be provided at only the exhaust valve 8 side or may be provided at both of the intake valve 6 side and the exhaust valve 8 side.

Further, the configuration shown in FIG. 11 has a variable valve timing mechanism 23 as an example of a variable intake apparatus, but the present invention can also be applied to cases of other variable intake apparatuses, for example swirl control valves. That is, for example, for estimation of the compliance parameters e and g of equation (27), in the same way as the above-mentioned method, it is possible to estimate compliance parameters emn and gmn at the time of any EGR control valve opening degree STPm and any swirl control valve state SCn, for each engine speed NE, from the compliance parameters eyn and gyn when the EGR control valve opening degree STP is a certain EGR control valve opening degree STPy and the swirl control valve is each state SCn and the compliance parameters emy and gmy when the swirl control valve is a certain state SCy and the EGR control valve opening degree STP is each EGR control valve opening degree STPm.

Note that the present invention was explained in detail based on specific embodiments, but a person skilled in the art could make various modifications, corrections, etc. without departing from the claims and concept of the present invention.

The invention claimed is:

1. A control system of an internal combustion engine provided with:

a throttle valve passage air flow calculation equation by which a throttle valve passage air flow is expressed as a function of a downstream side intake pipe pressure at the downstream side of a throttle valve and a cylinder intake air flow calculation equation by which a cylinder intake air flow is expressed as a function of said downstream side intake pipe pressure, said downstream side intake pipe pressure when the throttle valve passage air flow found from said throttle valve passage air flow calculation equation and the cylinder intake air flow found from said cylinder intake air flow calculation equation match being calculated as the downstream side intake pipe pressure at the time of steady operation under the operating conditions at that time.

2. A control system of an internal combustion engine as set forth in claim 1, wherein said cylinder intake air flow when a throttle valve passage air flow found from said throttle valve passage air flow calculation equation and a cylinder intake air flow found from said cylinder intake air flow calculation equation match is calculated as the cylinder intake air flow at the time of steady operation under the operating conditions at that time.

3. A control system of an internal combustion engine as set forth in claim 1, wherein said throttle valve passage air flow calculation equation is expressed as the following equation (1) where mt is a throttle valve passage air flow, μ is a flow coefficient at the throttle valve, At is a cross-sectional area of the opening of the throttle valve, Pa is an atmospheric pressure, Ta is an atmospheric temperature, R is a gas constant, Pm is said downstream side intake pipe pressure, and Φ(Pm/Pa) is a coefficient determined in accordance with the value of Pm/Pa, and said cylinder intake air flow calculation equation is expressed as the following equation (2) where mc is a cylinder intake air flow and a and b are compliance parameters determined based on at least the engine speed:

$$mt = \mu \cdot At \cdot \frac{\mathrm{Pa}}{\sqrt{R \cdot Ta}} \cdot \Phi\left(\frac{Pm}{\mathrm{Pa}}\right) \tag{1}$$

$$\mathrm{mc} = a \cdot Pm - b \tag{2}$$

4. A control system of an internal combustion engine as set forth in claim 3, wherein at a portion where the throttle valve passage air flow mt and cylinder intake air flow mc invert in magnitude, said throttle valve passage air flow calculation equation used is an approximation equation expressed by a linear equation of the downstream side intake pipe pressure Pm.

5. A control system of an internal combustion engine as set forth in claim 4, wherein said approximation equation is made a linear equation expressing a line connecting two points on a curve expressed by said throttle valve passage air flow calculation equation and before and after the point where the throttle valve passage air flow mt and cylinder intake air flow mc invert in magnitude.

6. A control system of an internal combustion engine as set forth in claim 4, wherein a throttle valve upstream side intake pipe pressure Pac found considering at least a pressure loss of an air cleaner is found based on the previously found throttle valve passage air flow, and said approximation equation is made a linear equation expressing a line connecting two points shown by coordinates obtained by multiplying Pac/Pa with values of the downstream side intake pipe pressure and the throttle valve passage air flow showing coordinates of two points on a curve expressed by said throttle valve passage air flow calculation equation and before and after a point where a throttle valve passage air flow mt and cylinder intake air flow mc invert in magnitude.

7. A control system of an internal combustion engine as set forth in claim 3, wherein instead of said atmospheric pressure Pa, a throttle valve upstream side intake pipe pressure Pac found considering at least a pressure loss of an air cleaner is used.

8. A control system of an internal combustion engine as set forth in claim 1, wherein said internal combustion engine has an exhaust gas recirculation passage for making at least part of the exhaust gas discharged into the exhaust passage flow into the intake passage and an EGR control valve for adjusting the flow of the exhaust gas passing through said exhaust gas recirculation passage, said throttle valve passage air flow calculation equation is expressed as the following equation (3) wherein mt is a throttle valve passage air flow, μ is a flow coefficient at the throttle valve, At is a cross-sectional area of the opening of the throttle valve, Pa is an atmospheric pressure, Ta is an atmospheric temperature, R is a gas constant, Pm is said downstream side intake pipe pressure, and Φ(Pm/Pa) is a coefficient determined in accordance with the value of Pm/Pa, and said cylinder intake air flow calculation equation is expressed as the following equation (4) where mc is a cylinder intake air flow, and e and g are compliance parameters determined based on at least the engine speed and the opening degree of said EGR control valve:

$$mt = \mu \cdot At \cdot \frac{Pa}{\sqrt{R \cdot Ta}} \cdot \Phi\left(\frac{Pm}{Pa}\right) \tag{3}$$

$$mc = e \cdot Pm + g. \tag{4}$$

9. A control system of an internal combustion engine as set forth in claim 8, wherein said internal combustion engine further has a variable valve timing mechanism for changing an operating timing of a valve provided in each cylinder and, based on said compliance parameters e and g when said operating timing is a first valve timing and said EGR control valve is at a first opening degree, said compliance parameters e and g when said operating timing is said first valve timing and said EGR control valve is at a second opening degree, and said compliance parameters e and g when said operating timing is a second valve timing and said EGR control valve is at a first opening degree, said compliance parameters e and g when said operating timing is said second valve timing and said EGR control valve is at said second opening degree are estimated.

10. A control system of an internal combustion engine as set forth in claim 9, wherein when said compliance parameters e and g, when said operating timing is said second valve timing and said EGR control valve is at a first opening degree, respectively, take two different values when said throttle valve downstream side intake pipe pressure is larger than and smaller than a first pressure and said compliance parameters e and g when said operating timing is said second valve timing and said EGR control valve is at said second opening degree are estimated to take three or more different values in accordance with said throttle valve downstream side intake pipe pressure, based on said compliance parameters e and g when said operating timing is a first valve timing and said EGR control valve is at a first opening degree, said compliance parameters e and g when said operating timing is said first valve timing and said EGR control valve is at a second opening degree, and said compliance parameters e and g when said operating timing is a second valve timing and said EGR control valve is at a first opening degree, approximated compliance parameters ep and gp designed to take two values differing when said throttle valve downstream side intake pipe pressure is larger and smaller than a first pressure are calculated and these are made said compliance parameters e and g when said operating timing is said second valve timing and said EGR control valve is at said second opening degree.

11. A control system of an internal combustion engine as set forth in claim 9, wherein the case where said EGR control valve is at said first opening degree is the case where said EGR control valve is closed.

12. A control system of an internal combustion engine provided with:

a throttle valve passage air flow calculation equation by which a throttle valve passage air flow is expressed as a function of a downstream side intake pipe pressure at the downstream side of a throttle valve and a cylinder intake air flow calculation equation by which a cylinder intake air flow is expressed as a function of said downstream side intake pipe pressure, said cylinder intake air flow when the throttle valve passage air flow found from said throttle valve passage air flow calculation equation and the cylinder intake air flow found from said cylinder intake air flow calculation equation match being calculated as the cylinder intake air flow at the time of steady operation under the operating conditions at that time.

13. A control system of an internal combustion engine as set forth in claim 12, wherein said throttle valve passage air flow calculation equation is expressed as the following equation (1) where mt is a throttle valve passage air flow, μ is a flow coefficient at the throttle valve, At is a cross-sectional area of the opening of the throttle valve, Pa is an atmospheric pressure, Ta is an atmospheric temperature, R is a gas constant, Pm is said downstream side intake pipe pressure, and Φ(Pm/Pa) is a coefficient determined in accordance with the value of Pm/Pa, and said cylinder intake air flow calculation equation is expressed as the following equation (2) where mc is a cylinder intake air flow and a and b are compliance parameters determined based on at least the engine speed:

$$mt = \mu \cdot At \cdot \frac{\mathrm{Pa}}{\sqrt{R \cdot Ta}} \cdot \Phi\left(\frac{Pm}{\mathrm{Pa}}\right) \tag{1}$$

$$\mathrm{mc} = a \cdot Pm - b \tag{2}$$

14. A control system of an internal combustion engine as set forth in claim 13, wherein at a portion where the throttle valve passage air flow mt and cylinder intake air flow mc invert in magnitude, said throttle valve passage air flow calculation equation used is an approximation equation expressed by a linear equation of the downstream side intake pipe pressure Pm.

15. A control system of an internal combustion engine as set forth in claim 14, wherein said approximation equation is made a linear equation expressing a line connecting two points on a curve expressed by said throttle valve passage air flow calculation equation and before and after the point where the throttle valve passage air flow mt and cylinder intake air flow mc invert in magnitude.

16. A control system of an internal combustion engine as set forth in claim 13, wherein instead of said atmospheric pressure Pa, a throttle valve upstream side intake pipe pressure Pac found considering at least a pressure loss of an air cleaner is used.

17. A control system of an internal combustion engine as set forth in claim 12, wherein said internal combustion engine has an exhaust gas recirculation passage for making at least part of the exhaust gas discharged into the exhaust passage flow into the intake passage and an EGR control valve for adjusting the flow of the exhaust gas passing through said exhaust gas recirculation passage, said throttle valve passage air flow calculation equation is expressed as the following equation (3) where mt is a throttle valve passage air flow, μ is a flow coefficient at the throttle valve, At is a cross-sectional area of the opening of the throttle valve, Pa is an atmospheric pressure, Ta is an atmospheric temperature, R is a gas constant, Pm is said downstream side intake pipe pressure, and Φ(Pm/Pa) is a coefficient determined in accordance with the value of Pm/Pa, and said cylinder intake air flow calculation equation is expressed as the following equation (4) where mc is a cylinder intake air flow, and e and g are compliance parameters determined based on at least the engine speed and the opening degree of said EGR control valve:

$$mt = \mu \cdot At \cdot \frac{Pa}{\sqrt{R \cdot Ta}} \cdot \Phi\left(\frac{Pm}{Pa}\right) \tag{3}$$

$$mc = e \cdot Pm + g. \tag{4}$$

18. A control system of an internal combustion engine as set forth in claim 17, wherein said internal combustion engine further has a variable valve timing mechanism for changing an operating timing of a valve provided in each cylinder and, based on said compliance parameters e and g when said operating timing is a first valve timing and said EGR control valve is at a first opening degree, said compliance parameters e and g when said operating timing is said first valve timing and said EGR control valve is at a second opening degree, and said compliance parameters e and g when said operating timing is a second valve timing and said EGR control valve is at a first opening degree, said compliance parameters e and g when said operating timing is said second valve timing and said EGR control valve is at said second opening degree are estimated.

19. A control system of an internal combustion engine as set forth in claim 18, wherein when said compliance parameters e and g when said operating timing is said second valve timing and said EGR control valve is at a first opening degree respectively take two values different when said throttle valve downstream side intake pipe pressure is larger than and smaller than a first pressure and said compliance parameters e and g when said operating timing is said second valve timing and said EGR control valve is at said second opening degree are estimated to take three or more different values in accordance with said throttle valve downstream side intake pipe pressure, based on said compliance parameters e and g when said operating timing is a first valve timing and said EGR control valve is at a first opening degree, said compliance parameters e and g when said operating timing is said first valve timing and said EGR control valve is at a second opening degree, and said compliance parameters e and g when said operating timing is a second valve timing and said EGR control valve is at a first opening degree, approximated compliance parameters ep and gp designed to take two different values when said throttle valve downstream side intake pipe pressure is larger than and smaller than a first pressure are calculated and these are made said compliance parameters e and g when said operating timing is said second valve timing and said EGR control valve is at said second opening degree.

20. A control system of an internal combustion engine as set forth in claim 18, wherein the case where said EGR control valve is at said first opening degree is the case where said EGR control valve is closed.

* * * * *